US011592229B2

(12) United States Patent
Jeong et al.

(10) Patent No.: US 11,592,229 B2
(45) Date of Patent: Feb. 28, 2023

(54) REFRIGERATOR

(71) Applicant: Samsung Electronics Co., Ltd., Suwon-si (KR)

(72) Inventors: Youngkyun Jeong, Suwon-si (KR); Jaemin Park, Suwon-si (KR); Yongsoo Kyong, Suwon-si (KR); Joosang Yoo, Suwon-si (KR); Sungmo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 80 days.

(21) Appl. No.: 17/150,066

(22) Filed: Jan. 15, 2021

(65) Prior Publication Data

US 2021/0247128 A1 Aug. 12, 2021

(30) Foreign Application Priority Data

Feb. 7, 2020 (KR) ..... 10-2020-0015237

(51) Int. Cl.
*F25D 23/02* (2006.01)
*E05D 7/04* (2006.01)

(52) U.S. Cl.
CPC ..... *F25D 23/028* (2013.01); *E05D 7/04* (2013.01); *E05D 2007/0469* (2013.01);
(Continued)

(58) Field of Classification Search
CPC ..... F25D 23/028; F25D 2323/024; F25D 2323/021; F25D 2500/02; E05D 7/04;
(Continued)

(56) References Cited

U.S. PATENT DOCUMENTS 5,052,077 A * 10/1991 Lautenschlager ..... E05D 7/125 16/257
5,920,958 A * 7/1999 Domenig ..... E05D 7/0423 16/245

(Continued)

FOREIGN PATENT DOCUMENTS

CN 204438650 U 7/2015
CN 105546912 A 5/2016

(Continued)

OTHER PUBLICATIONS

International Search Report (PCT/ISA/210) and Written Opinion of the International Searching Authority (PCT/ISA/237) dated May 12, 2021, in corresponding International Patent Application No. PCT/KR2021/000882.

(Continued)

*Primary Examiner* — Hanh V Tran
(74) *Attorney, Agent, or Firm* — Staas & Halsey LLP

(57) ABSTRACT

A refrigerator includes a cabinet: a door formed to open and close the cabinet; an upper moving part coupled to the door and formed to be moved in a first direction with respect to the cabinet; a lower moving part disposed under the upper moving part, including an upper adjustment member configured to move the upper moving part in the first direction, and guiding the upper moving part to be linearly moved in the first direction; and a fixing part fixed to the cabinet under the lower moving part, including a lower adjustment member configured to move the lower moving part in a second direction perpendicular to the first direction, and guiding the lower moving part to be linearly moved in the second direction.

12 Claims, 25 Drawing Sheets

(52) U.S. Cl.
CPC ... *E05D 2007/0484* (2013.01); *E05Y 2900/31* (2013.01); *F25D 2323/024* (2013.01)

(58) Field of Classification Search
CPC .... E05D 2007/0484; E05D 2007/0469; E05D 7/081; E05D 7/0423; E05Y 2900/31; E05Y 2600/12; E05Y 2600/51; E05Y 2600/61
See application file for complete search history.

(56) References Cited

U.S. PATENT DOCUMENTS

| | | | | |
|---|---|---|---|---|
| 6,715,181 | B1 * | 4/2004 | Fries | E05D 7/123 16/272 |
| 7,213,300 | B1 * | 5/2007 | Domenig | E05D 7/04 16/236 |
| 7,509,708 | B1 * | 3/2009 | Radke | E05D 7/081 16/245 |
| 8,506,026 | B2 | 8/2013 | Kim et al. | |
| 9,874,049 | B1 * | 1/2018 | McGregor | E05D 5/065 |
| 10,480,228 | B2 | 11/2019 | Kim et al. | |
| 2006/0137139 | A1 * | 6/2006 | Wu | E05D 7/0423 16/236 |
| 2008/0168618 | A1 * | 7/2008 | Hottmann | E05F 1/1253 16/50 |
| 2010/0033067 | A1 * | 2/2010 | Kim | E05D 7/12 16/221 |
| 2012/0032572 | A1 * | 2/2012 | Lee | F25D 23/028 312/405 |
| 2015/0135479 | A1 * | 5/2015 | Salice | E05D 5/0276 16/236 |
| 2016/0145921 | A1 * | 5/2016 | Laird | F16B 2/185 29/428 |
| 2017/0138104 | A1 * | 5/2017 | Kim | F25D 23/028 |
| 2017/0176088 | A1 * | 6/2017 | Richards | F25D 23/028 |
| 2018/0016825 | A1 * | 1/2018 | Pyo | E05D 7/0009 |
| 2018/0156531 | A1 * | 6/2018 | Heisswolf | E05D 7/0415 |

FOREIGN PATENT DOCUMENTS

| | | | | |
|---|---|---|---|---|
| EP | 2 420 775 | A2 | 2/2012 | |
| JP | 11159948 | A * | 6/1999 | E05D 7/081 |
| JP | 2004-324263 | A | 11/2004 | |
| KR | 10-0187204 | | 4/1999 | |
| KR | 10-1999-0060678 | | 7/1999 | |
| KR | 10-1999-0063575 | A | 7/1999 | |
| KR | 10-0299874 | | 11/2001 | |
| KR | 200309593 | Y1 * | 4/2003 | |
| KR | 10-2010-0019616 | | 2/2010 | |
| KR | 10-2013-0021670 | A | 3/2013 | |
| KR | 10-2017-0058063 | A | 5/2017 | |

OTHER PUBLICATIONS

European Search Report dated Sep. 15, 2022, in the European Patent Application No. 21750204.6.

* cited by examiner

REFRIGERATOR

CROSS-REFERENCE TO RELATED APPLICATIONS

This application is based on and claims priority under 35 U.S.C. § 119 to Korean Patent Application No. 10-2020-0015237, filed on Feb. 7, 2020, in the Korean Intellectual Property Office, the disclosure of which is incorporated by reference herein in its entirety.

BACKGROUND

1. Field

The disclosure relates to a refrigerator, and more particularly, to a refrigerator capable of adjusting a level difference and a gap between doors.

2. Description of the Related Art

Generally, a refrigerator is a device for storing food at low temperature, and may freeze or refrigerate food according to a condition of the food to be stored.

Such a refrigerator includes a cabinet including an internal space divided into a refrigerating chamber and a freezing chamber, and a door disposed on the front of the cabinet to selectively open and close the internal space of the cabinet.

The upper and lower ends of the door are supported by upper and lower hinges, respectively, so that the door may be opened and closed with respect to the front surface of the cabinet.

In the case of a two-door refrigerator, there may be a level difference between the left door and the right door, or a gap between the left door and the right door may not be uniform up and down.

When a consumer purchases a refrigerator having such a problem, the consumer requests a return. Therefore, there is a problem that the manufacturing cost of the refrigerator increases.

SUMMARY

The disclosure has been developed in order to overcome the above drawbacks and other problems associated with the conventional arrangement. An aspect of the disclosure is to provide a refrigerator capable of adjusting a level difference and a gap between a left door and a right door.

According to an aspect of the disclosure, a refrigerator may include a cabinet: a door formed to open and close the cabinet; an upper moving part coupled to the door and formed to be moved in a first direction with respect to the cabinet; a lower moving part disposed under the upper moving part, including an upper adjustment member configured to move the upper moving part in the first direction, and guiding the upper moving part to be linearly moved in the first direction; and a fixing part fixed to the cabinet under the lower moving part, including a lower adjustment member configured to move the lower moving part in a second direction perpendicular to the first direction, and guiding the lower moving part to be linearly moved in the second direction.

The upper adjustment member may include an upper fixing portion extending vertically from one end of the lower moving part; and an upper adjustment bolt fastened to the upper fixing portion and to move the upper moving part in the first direction with respect to the lower moving part.

The lower adjustment member may include a lower fixing portion extending vertically from one end of the fixing part; and a lower adjustment bolt fastened to the lower fixing portion and to move the lower moving part in the second direction with respect to the fixing part.

The upper moving part may include a pair of upper slide surfaces formed in parallel in the first direction, and the lower moving part may include a pair of upper guide portions to guide the pair of upper slide surfaces so that the upper moving part linearly moves in the first direction.

The lower moving part may include a pair of lower slide surfaces formed in parallel in the second direction, and the fixing part may include a pair of lower guide portions to guide the pair of lower slide surfaces so that the lower moving part linearly moves in the second direction.

According to another aspect of the disclosure, a refrigerator may include a cabinet: a left door disposed to open and close a left side of a front surface of the cabinet; a right door disposed to open and close a right side of the front surface of the cabinet; a left hinge formed to support the left door to rotate with respect to the cabinet, and to move the left door in a direction perpendicular to or parallel to the front surface of the cabinet; and a right hinge formed to support the right door to rotate with respect to the cabinet, and to move the right door in a direction parallel to or perpendicular to the front surface of the cabinet.

The left hinge may include a left fixing part fixed to the cabinet; a vertical moving part disposed on the left fixing part and to be linearly moved in a direction perpendicular to the front surface of the cabinet; and a vertical adjustment member provided at the left fixing part and formed to linearly move the vertical moving part in a direction perpendicular to the front surface of the cabinet.

The right hinge may include a right fixing part fixed to the cabinet; a horizontal moving part disposed on the right fixing part and to be linearly moved in a direction parallel to the front surface of the cabinet; and a horizontal adjustment member provided at the right fixing part and formed to linearly move the horizontal moving part in a direction parallel to the front surface of the cabinet.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION

Various embodiments of the disclosure will hereinafter be described with reference to the accompanying drawings. However, it is to be understood that technologies mentioned in the disclosure are not limited to specific embodiments, but include various modifications, equivalents, and/or alternatives according to embodiments of the disclosure. The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the present disclosure, a first component may be referred to as a second component, and similarly, a second component may also be referred to as a first component.

The terms used in embodiments of the present disclosure may be construed as commonly known to those skilled in the art unless otherwise defined.

Further, the terms 'leading end', 'rear end', 'upper side', 'lower side', 'top end', 'bottom end', etc. used in the present disclosure are defined with reference to the drawings. However, the shape and position of each component are not limited by the terms.

Hereinafter, embodiments of a refrigerator according to the disclosure will be described in detail with reference to the accompanying drawings.

Figure 1:
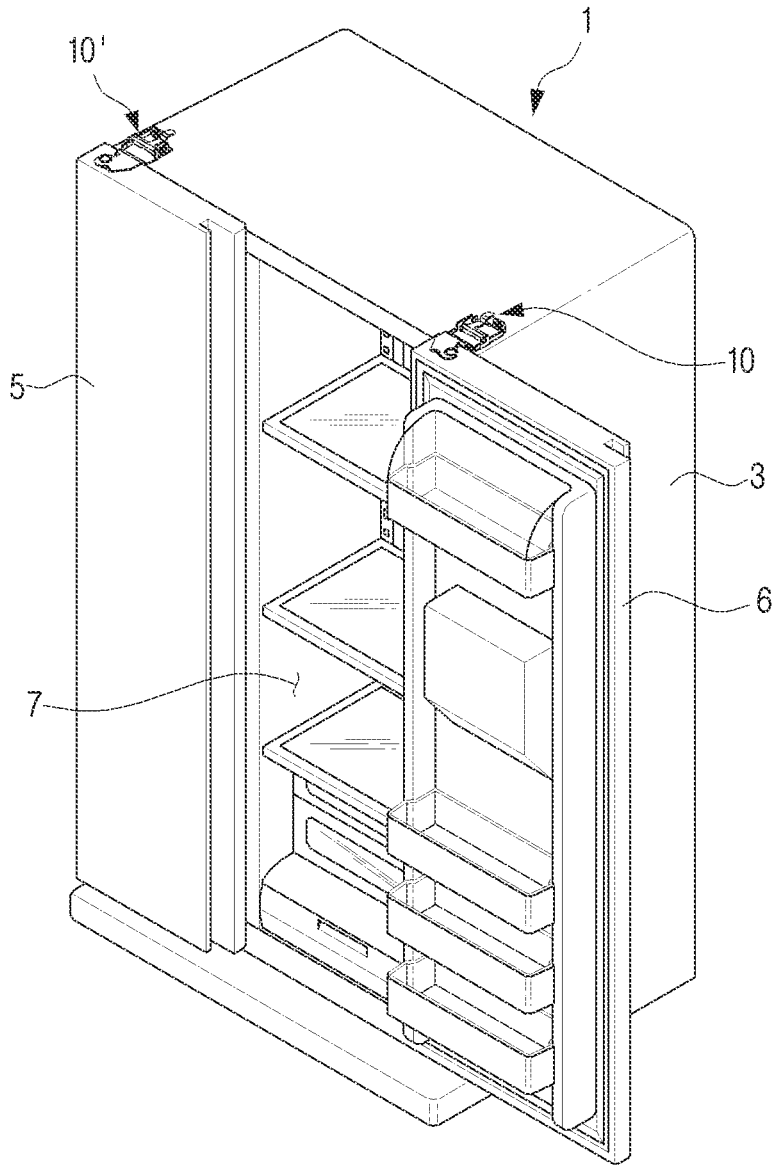
FIG. 1 is a perspective view illustrating a refrigerator according to an embodiment.

FIG. 1 is a perspective view illustrating a refrigerator according to an embodiment.

Referring to FIG. 1, a refrigerator 1 according to an embodiment of the disclosure may include a cabinet 3 and a pair of doors 5 and 6.

The cabinet 3 forms the appearance of the refrigerator 1. The interior space of the cabinet 3 may be divided into a freezer compartment (not illustrated) for freezing food and a refrigerator compartment 7 for refrigerating food. In the refrigerator 1 illustrated in FIG. 1, the freezer compartment is provided on the left and the refrigerator compartment 7 is provided on the right.

The pair of doors, that is, a left door 5 and a right door 6 are disposed in the front surface of the cabinet 3. The left door 5 is rotatably disposed on the left side of the front surface of the cabinet 3 to selectively open and close the freezer compartment. The right door 6 is rotatably disposed on the right side of the front surface of the cabinet 3 to selectively open and close the refrigerator compartment 7.

The upper and lower ends of each of the left door 5 and the right door 6 may be supported by hinges, so that each of the left door 5 and the right door 6 may be opened and closed with respect to the front surface of the cabinet 3. A left hinge 10' may be disposed on the left side of the upper surface of the cabinet 3, so that the left door 5 is opened and closed with respect to the front surface of the cabinet 3. A right hinge 10 may be disposed on the right side of the upper surface of the cabinet 3, so that the right door 6 is opened and closed with respect to the front surface of the cabinet 3.

The left hinge 10' disposed on the upper end of the left door 5 and the right hinge 10 disposed on the upper end of the right door 6 may have the same structure; therefore, the right hinge 10 will be disclosed as an example, hereinafter. However, there is a difference in that the left hinge 10' and the right hinge 10 have a line-symmetric structure. Hereinafter, for convenience of description, the right hinge 10 will be referred to as a hinge.

Figure 2:
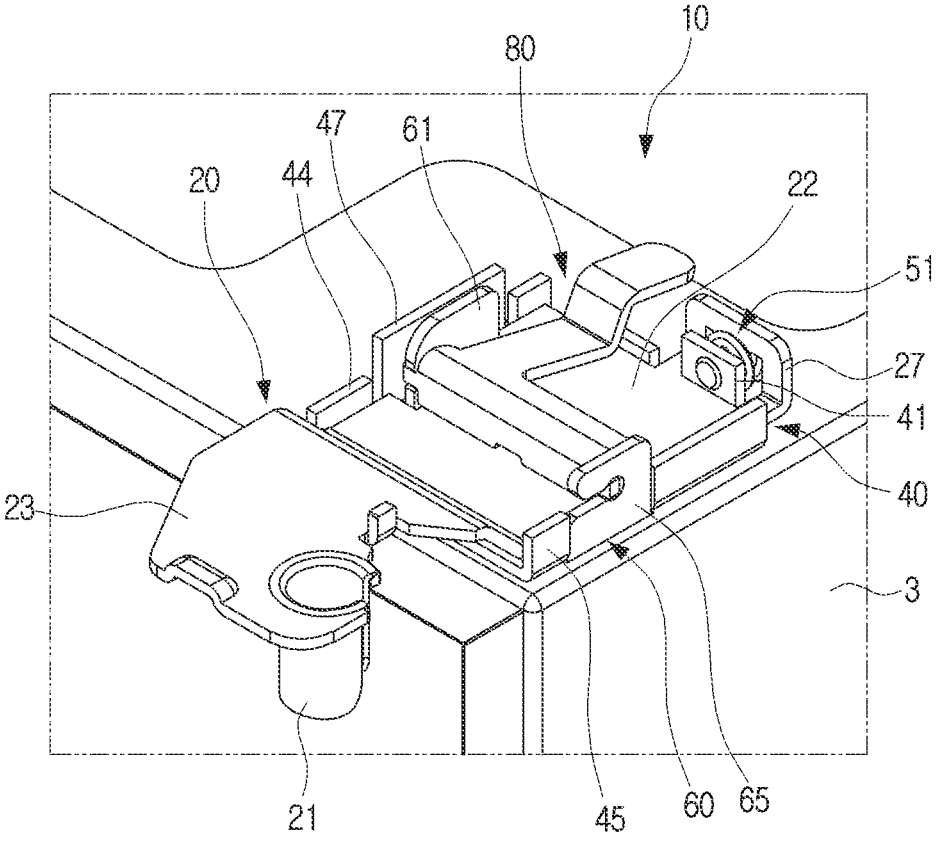
FIG. 2 is a perspective view illustrating a hinge disposed at an upper end of a refrigerator according to an embodiment.
Figure 3:
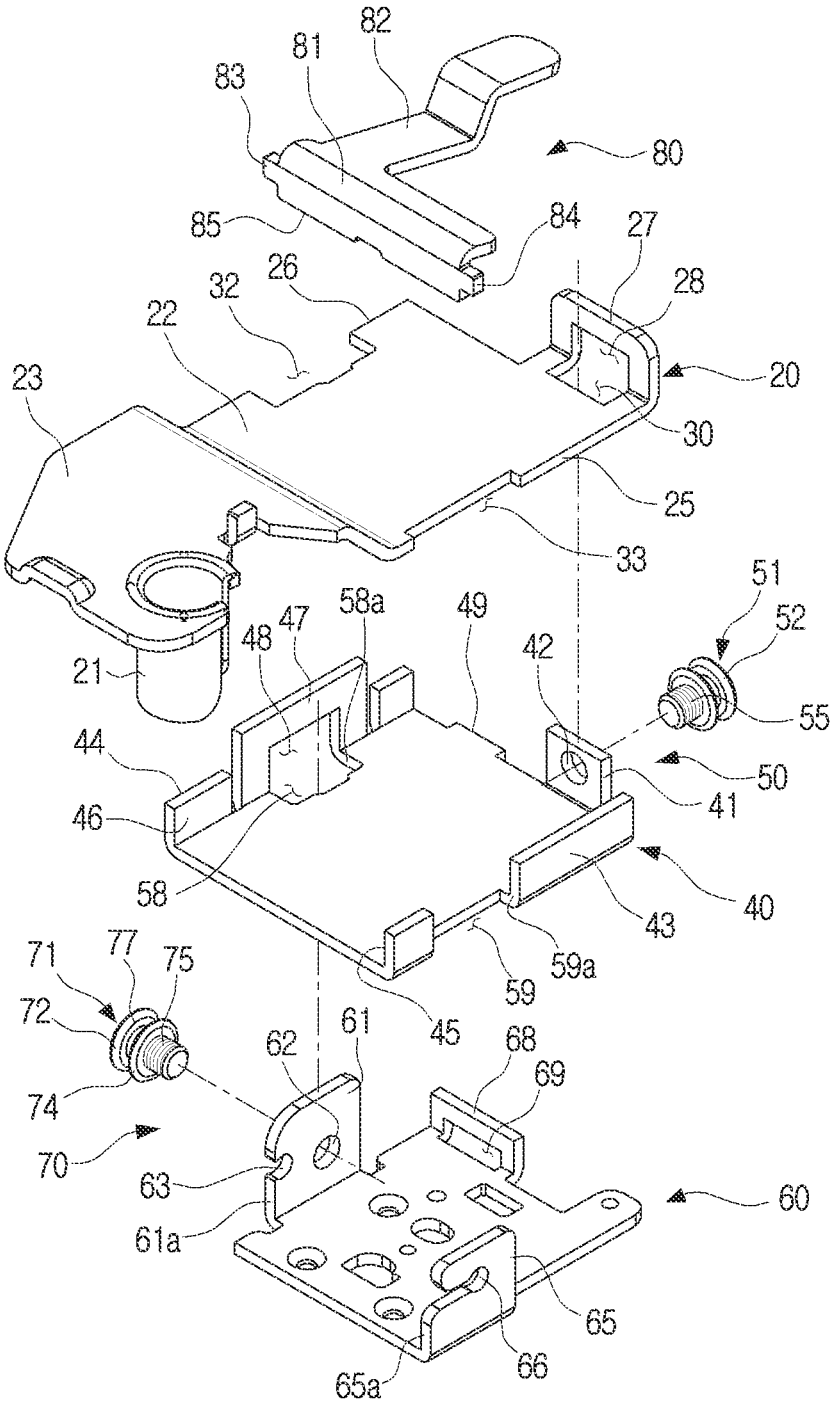
FIG. 3 is an exploded perspective view illustrating the hinge of FIG. 2.
Figure 4:
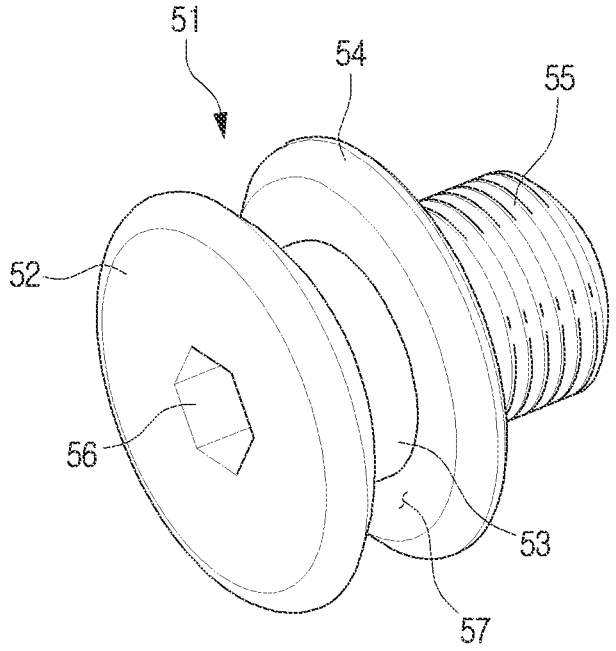
FIG. 4 is a perspective view illustrating an upper adjustment bolt of FIG. 2.

FIG. 2 is a perspective view illustrating a hinge disposed on an upper end of a refrigerator according to an embodiment. FIG. 3 is an exploded perspective view illustrating the hinge of FIG. 2. FIG. 4 is a perspective view illustrating an upper adjustment bolt of FIG. 2.

Referring to FIGS. 2 and 3, a hinge 10 of an embodiment of the disclosure may include an upper moving part 20, a lower moving part 40, and a fixing part 60.

The upper moving part 20 may be coupled to the door 6 and may be formed to be movable in a first direction with respect to the cabinet 3. One end of the upper moving part 20 may be provided with a cylindrical hinge shaft 21 to be coupled to the door 6. A hinge hole 6*a* into which the hinge shaft 21 is inserted may be provided at the upper end of the door 6. Accordingly, because the door 6 may rotate at a predetermined angle based on the hinge shaft 21, the door 6 may selectively open and close the inner space of the cabinet 3. Here, the first direction refers to a direction perpendicular to the front surface of the cabinet 3.

The upper moving part 20 may be disposed on the upper side of the lower moving part 40 disposed in the cabinet 3, and may be formed to move linearly in the first direction with respect to the cabinet 3. The upper moving part 20 may be formed of a flat plate, and may include a slide portion 22 that is in contact with the lower moving part 40 and slides with respect to the lower moving part 40 and a hinge portion 23 in which the hinge shaft 21 is disposed. The hinge portion 23 may be formed by being bent to have a predetermined level difference with respect to the slide portion 22. The slide portion 22 and the hinge portion 23 may be formed to be parallel to each other. The hinge shaft 21 may be disposed perpendicular to the hinge portion 23.

The slide portion 22 may be formed in a substantially rectangular flat plate. Both side surfaces of the slide portion 22 may be formed to be parallel to each other. The both side surfaces of the slide portion 22 may form slide surfaces 25 and 26 that are in contact with the lower moving part 40 when the slide portion 22 moves linearly in one direction with respect to the lower moving part 40. In other words, a pair of slide surfaces 25 and 26 may be formed on both side surfaces of the slide portion 22 of the upper moving part 20. Accordingly, the upper moving part 20 may include the pair of upper slide surfaces 25 and 26 formed in the first direction.

A first lower opening 32 through which a lower fixing portion 61 of the fixing part 60 protrudes may be provided on one side surface 26 of the slide portion 22. A second lower opening 33 through which a support portion 65 of the fixing part 60 protrudes may be provided on the opposite side surface 25 of the slide portion 22. Each of the first lower opening 32 and the second lower opening 33 may be formed to have a width greater than the width W4 of the lower fixing portion 61 and the width of the support portion 65, so that the upper moving part 20 may move a predetermined distance without interference with the lower fixing portion 61 and the support portion 65.

The lower moving part 40 may be disposed under the upper moving part 20 and may include an upper adjustment member 50 configured to move the upper moving part 20 in the first direction. In addition, the lower moving part 40 may be formed to guide the upper moving part 20 to linearly move in the first direction. The lower moving part 40 may be formed to move linearly in a second direction. Here, the second direction refers to a direction parallel to the front surface of the cabinet 3. Therefore, the second direction is a direction perpendicular to the first direction.

A first slide plate (not illustrated) may be disposed between the lower moving part 40 and the upper moving part 20 so that the upper moving part 20 may slide smoothly with respect to the lower moving part 40.

The lower moving part 40 may be formed in an approximately rectangular flat plate. An upper fixing portion 41 may extend vertically from one end of the lower moving part 40. An upper bolt hole 42 into which an upper adjustment bolt 51 is fastened may be formed in the upper fixing portion 41. A female thread may be formed in the upper bolt hole 42 of the upper fixing portion 41. The upper fixing portion 41 may be formed at one end of the lower moving part 40 in the first direction in which the upper moving part 20 moves.

Referring to FIGS. 2 to 4, the upper adjustment bolt 51 may include a head 52, a body 53, and an intermediate ring 54.

The head 52 may be formed to turn the upper adjustment bolt 51. For example, a hexagonal hole 56 into which a hexagonal wrench is inserted may be formed in the surface of the head 52.

The body 53 may extend vertically from the lower surface of the head 52 and may be formed in a cylindrical shape. The lower portion of the body 53 may be provided with a threaded portion 55 on which a male thread is formed. The threaded portion 55 may be formed from one end of the body 53 to the intermediate ring 54. The threaded portion 55 of the upper adjustment bolt 51 may be formed to be fastened to the upper bolt hole 42 of the upper fixing portion 41. Accordingly, the threaded portion 55 of the upper adjustment bolt 51 may be fastened to the female thread of the upper bolt hole 42 of the upper fixing portion 41.

The intermediate ring 54 may be formed on the body 53 so as to be spaced apart from the head 52 by a predetermined distance. A space between the intermediate ring 54 and the head 52 may form an engaging groove 57. The engaging groove 57 may be formed so that an upper hooking portion 27 of the upper moving part 20 is inserted into the engaging groove 57. The upper hooking portion 27 may be formed so that, when the upper hooking portion 27 is inserted into the engaging groove 57 of the upper adjustment bolt 51, the upper hooking portion 27 does not move with respect to the engaging groove 57.

The upper hooking portion 27 of the upper moving part 20 may be formed at one end of the slide portion 22. The upper hooking portion 27 may be formed at one end of the slide portion 22 facing the hinge shaft 21. The upper hooking portion 27 may extend vertically from one end of the slide portion 22 of the upper moving part 20, and may be bent so that the upper hooking portion 27 is inserted into the engaging groove 57 of the upper adjustment bolt 51. An opening 28 into which the head 52 of the upper adjustment bolt 51 is inserted may be formed under the upper hooking portion 27.

In addition, an upper avoidance opening 30 into which the upper fixing portion 41 of the lower moving part 40 is inserted may be provided in the slide portion 22 in front of the upper hooking portion 27. The width W1 (see FIG. 5A) of the upper avoidance opening 30 of the upper moving part 20 may be formed to be wider than the width W2 (see FIG. 5A) of the upper fixing portion 41 of the lower moving part 40.

The depth D1 (see FIG. 5A) of the upper avoidance opening 30 may be formed to have a size corresponding to a moving distance of the upper moving part 20 in the first direction. Accordingly, the distance in which the upper moving part 20 moves in the first direction may be limited by the depth D1 of the upper avoidance opening 30.

Therefore, after hooking the upper hooking portion 27 of the upper moving part 20 to the engaging groove 57 of the upper adjustment bolt 51 of the lower moving part 40, turning the upper adjustment bolt 51, the upper moving part 20 may move in the first direction with respect to the lower moving part 40. In detail, in a state in which the central portion of the upper hooking portion 27 of the upper moving part 20 is inserted into the engaging groove 57 of the upper adjustment bolt 51 of the lower moving part 40, when the upper adjustment bolt 51 is rotated, the upper hooking portion 27 is linearly moved by the upper adjustment bolt 51. Because the upper hooking portion 27 is formed integrally with the upper moving part 20, when the upper hooking portion 27 is moved, the upper moving part 20 is moved with respect to the lower moving part 40.

The upper fixing portion 41 and the upper adjustment bolt 51 provided in the lower moving part 40 may form the upper adjustment member 50 capable of moving the upper moving part 20 in the first direction.

The lower moving part 40 may include a pair of lower guide portions 45 and 46 that guide the pair of the upper slide surfaces 25 and 26 of the upper moving part 20 so that the upper moving part 20 moves linearly in the first direction. The lower moving part 40 may include a pair of sidewalls 43 and 44 extending vertically from the both side surfaces thereof, that is, a first sidewall 43 and a second sidewall 44. The pair of sidewalls 43 and 44 may extend from both side surfaces of the lower moving part 40 perpendicular to one end of the lower moving part 40 on which the upper fixing portion 41 is formed. The pair of lower guide portions 45 and 46 may be formed on the inner surfaces of the pair of sidewalls 43 and 44 of the lower moving part 40.

The upper moving part 20 may be disposed between the pair of sidewalls 43 and 44 on the upper surface of the lower moving part 40, and may slide along the pair of sidewalls 43 and 44. In other words, the pair of sidewalls 43 and 44 of the lower moving part 40 may be formed in the first direction, and may face the pair of upper slide surfaces 25 and 26 of the upper moving part 20.

An insertion protrusion 49 may be formed at one end of the lower moving part 40 on which the upper fixing portion 41 is formed. The insertion protrusion 49 may be formed to be spaced apart from the upper fixing portion 41 by a predetermined distance.

The fixing part 60 may be disposed under the lower moving part 40 and may be fixed to the cabinet 3. The fixing part 60 may include a lower adjustment member 70 for moving the lower moving part 40 in the second direction, and may be formed to guide the lower moving part 40 to linearly move in the second direction.

The fixing part 60 may be formed in an approximately rectangular flat plate. The lower fixing portion 61 may extend vertically from one end of the fixing part 60. A lower bolt hole 62 into which a lower adjustment bolt 71 is fastened may be formed in the lower fixing portion 61. A female thread may be formed in the lower bolt hole 62 of the lower fixing portion 61. The lower fixing portion 61 may be formed at one end of the fixing part 60 in the direction in which the lower moving part 40 moves. A first rotation groove 63 into which a first rotation protrusion 83 of a hinge clamp 80 is inserted may be formed on one side surface of the lower fixing portion 61.

The lower adjustment bolt 71 may include a head 72, a body, and an intermediate ring 74. The lower adjustment bolt 71 is formed in the same manner as the upper adjustment bolt 51 described above; therefore, a detailed description thereof is omitted. An engaging groove 77 into which a lower hooking portion 47 of the lower moving part 40 is inserted may be formed between the head 72 and the intermediate ring 74 of the lower adjustment bolt 71.

The lower hooking portion 47 of the lower moving part 40 may be formed on one side surface of the lower moving part 40. The lower hooking portion 47 may be formed on one side surface of the lower moving part 40 that is formed at a right angle to one end of the lower moving part 40 on which the upper fixing portion 41 is provided. In other words, the lower hooking portion 47 may be formed on the second sidewall 44 of the lower moving part 40. An opening 48 into which the head 72 of the lower adjustment bolt 71 is inserted may be formed in the lower hooking portion 47. In other words, the lower hooking portion 47 may extend vertically from one side surface of the lower moving part 40 and may be bent so as to be inserted into the engaging groove 77 of the lower adjustment bolt 71.

In addition, a lower avoidance opening 58 into which the lower fixing portion 61 of the fixing part 60 is inserted may be provided in the lower moving part 40 in front of the lower hooking portion 47. The lower avoidance opening 58 may be formed in a rectangular shape.

The width W3 (see FIG. 6A) of the lower avoidance opening 58 of the lower moving part 40 may be formed to have a size corresponding to the width W4 (see FIG. 6A) of the lower fixing portion 61 of the fixing part 60. For example, the width W3 of the lower avoidance opening 58 may be determined so that both inner side surfaces 58*a* of the lower avoidance opening 58 are in contact with and slide with respect to both side surfaces 61*a* of the lower fixing portion 61.

The depth D3 (see FIG. 6A) of the lower avoidance opening 58 may be formed to have a size corresponding to a moving distance of the lower moving part 40 in the second direction. Accordingly, the distance in which the lower moving part 40 moves in the second direction may be limited by the depth D3 of the lower avoidance opening 58.

Therefore, after inserting the lower hooking portion 47 of the lower moving part 40 into the engaging groove 77 of the lower adjustment bolt 71 of the fixing part 60, turning the lower adjustment bolt 71, the lower moving part 40 may be moved in the second direction with respect to the fixing part 60. In detail, in a state in which the central portion of the lower hooking portion 47 of the lower moving part 40 is inserted into the engaging groove 77 of the lower adjustment bolt 71 of the fixing part 60, when the lower adjustment bolt 71 is rotated, the lower hooking portion 47 is linearly moved by the lower adjustment bolt 71. Because the lower hooking portion 47 is formed integrally with the lower moving part 40, when the lower hooking portion 47 is moved, the lower moving part 40 is moved with respect to the fixing part 60.

The lower fixing portion 61 and the lower adjustment bolt 71 provided in the fixing part 60 may form the lower adjustment member 70 capable of moving the lower moving part 40 in the second direction.

The lower moving part 40 may include a pair of lower slide surfaces 58*a* formed to be parallel to each other in the second direction. The pair of lower slide surfaces 58*a* may guide the lower moving part 40 to linearly move in the second direction. The pair of lower slide surfaces 58*a* may be formed as both inner side surfaces of the lower avoidance opening 58 of the lower moving part 40.

In addition, the pair of lower slide surfaces 58*a* may further include lower sub-slide surfaces 59*a* formed on both inner side surfaces of a guide opening 59 formed in the first sidewall 43 of the lower moving part 40. The guide opening 59 of the lower moving part 40 may be formed so that the support portion 65 of the fixing part 60 is inserted. The width of the guide opening 59 may be formed to have a size corresponding to the width of the support portion 65 of the fixing part 60. For example, the width of the guide opening 59 may be determined so that both inner side surfaces of the guide opening 59 are in contact with and slide with respect to both side surfaces 65*a* of the support portion 65.

The fixing part 60 may include a pair of lower guide portions 61*a* formed to guide the pair of lower slide surfaces 58*a* so that lower moving part 40 linearly moves in the second direction. The pair of lower guide portions 61*a* of the fixing part 60 may be formed as both side surfaces of the lower fixing portion 61 extending vertically from one side surface of the fixing part 60.

In addition, the fixing part 60 may further include a pair of lower sub-guide portions 65*a*. The pair of lower sub-guide portions 65*a* may be formed as both side surfaces of the support portion 65 extending vertically from one side surface of the fixing part 60. The support portion 65 may be formed on the fixing part 60 to be parallel to the lower fixing portion 61 and to face the lower fixing portion 61. Both side surfaces of the support portion 65 may be formed to slide in contact with the pair of lower sub-slide surfaces 59*a* provided on both inner side surfaces of the guide opening 59 of the lower moving part 40. A second rotation groove 66 into which a second rotation protrusion 84 of the hinge clamp 80 is inserted may be provided on one side surface of the support portion 65.

A fixing wall 68 may be formed on one side surface of the fixing part 60, that is, on one side surface of the fixing part 60 perpendicular to the lower fixing portion 61. The fixing wall 68 may extend vertically from one side surface of the fixing part 60. An insertion groove 69 into which the insertion protrusion 49 of the lower moving part 40 is inserted may be formed at a lower portion of the fixing wall 68. The width of the insertion groove 69 may be formed larger than the width of the insertion protrusion 49. Accordingly, when the lower moving part 40 moves in the second direction, the insertion protrusion 49 does not interfere with the insertion groove 69 of the fixing part 60.

The hinge 10 may further include the hinge clamp 80. The hinge clamp 80 may be formed to fix the upper moving part 20 and the lower moving part 40 to the fixing part 60.

The hinge clamp 80 may include a pressing portion 81 and a handle 82. A pair of rotation protrusions, that is, a first rotation protrusion 83 and a second rotation protrusion 84 may be provided at both ends of the pressing portion 81. The first rotation protrusion 83 may be formed to be inserted into the first rotation groove 63 of the lower fixing portion 61 of the fixing part 60, and the second rotation protrusion 84 may be formed to be inserted into the second rotation groove 66 of the support portion 65 of the fixing part 60. Accordingly, the pressing portion 81 may rotate based on the pair of rotation protrusions 83 and 84 inserted into the first rotation groove 63 and the second rotation groove 66 of the fixing part 60. The lower end 85 of the pressing portion 81 may be formed to press the upper surface of the upper moving part 20.

The handle 82 may extend approximately vertically from the pressing portion 81. The user may rotate the pressing portion 81 while holding the handle 82.

When the lower end 85 of the pressing portion 81 presses the upper surface of the upper moving part 20, the upper moving part 20 and the lower moving part 40 are fixed and do not move. When the lower end 85 of the pressing portion 81 does not contact the upper surface of the upper moving part 20, the upper moving part 20 and the lower moving part 40 may be moved by the upper adjustment member 50 and the lower adjustment member 70.

Hereinafter, the operation of the hinge 10 according to an embodiment of the disclosure will be described in detail with reference to FIGS. 5A, 5B, 6A, and 6B.

Figure 5A:
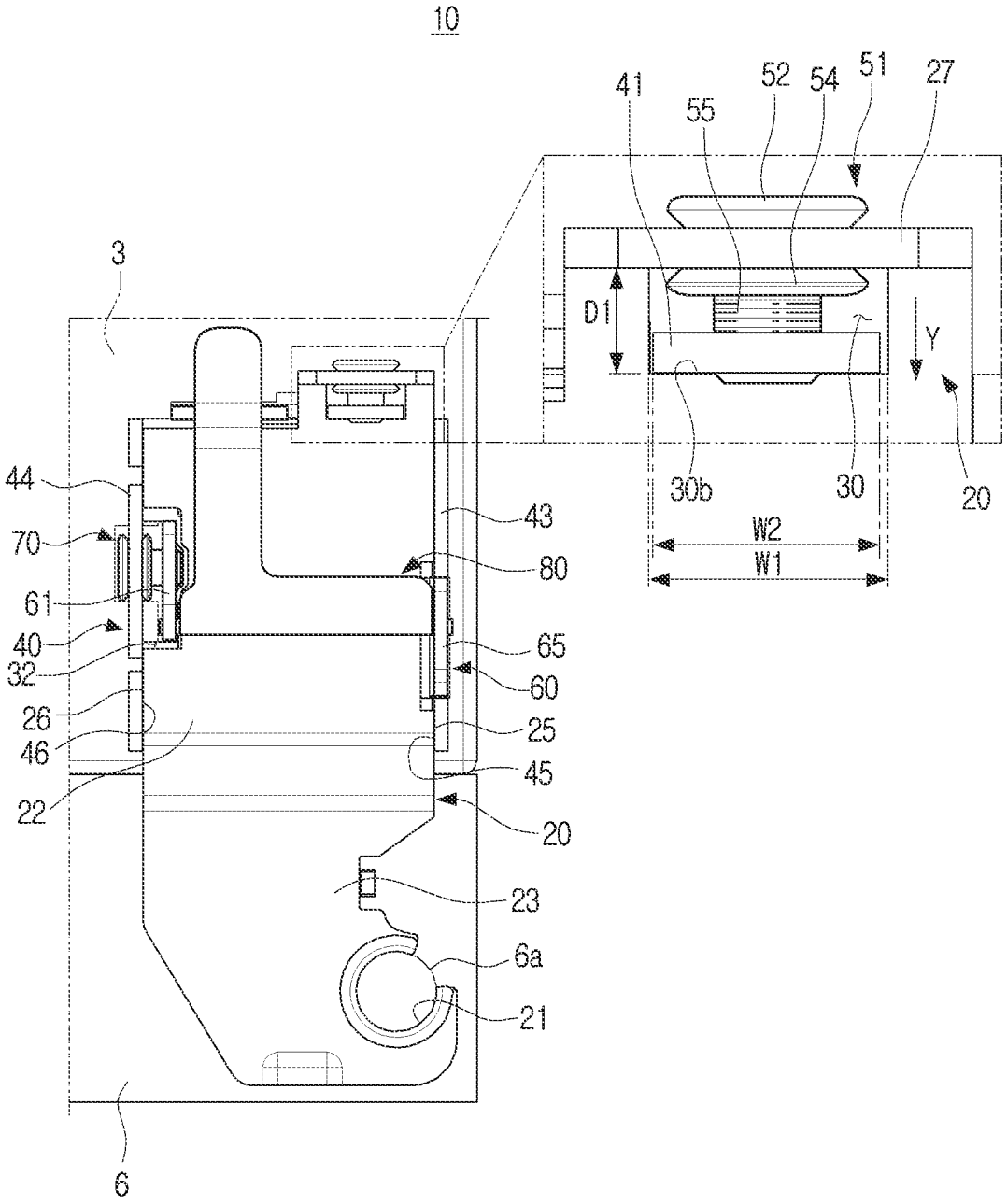
FIG. 5A is a plan view illustrating a hinge according to an embodiment.
Figure 5B:
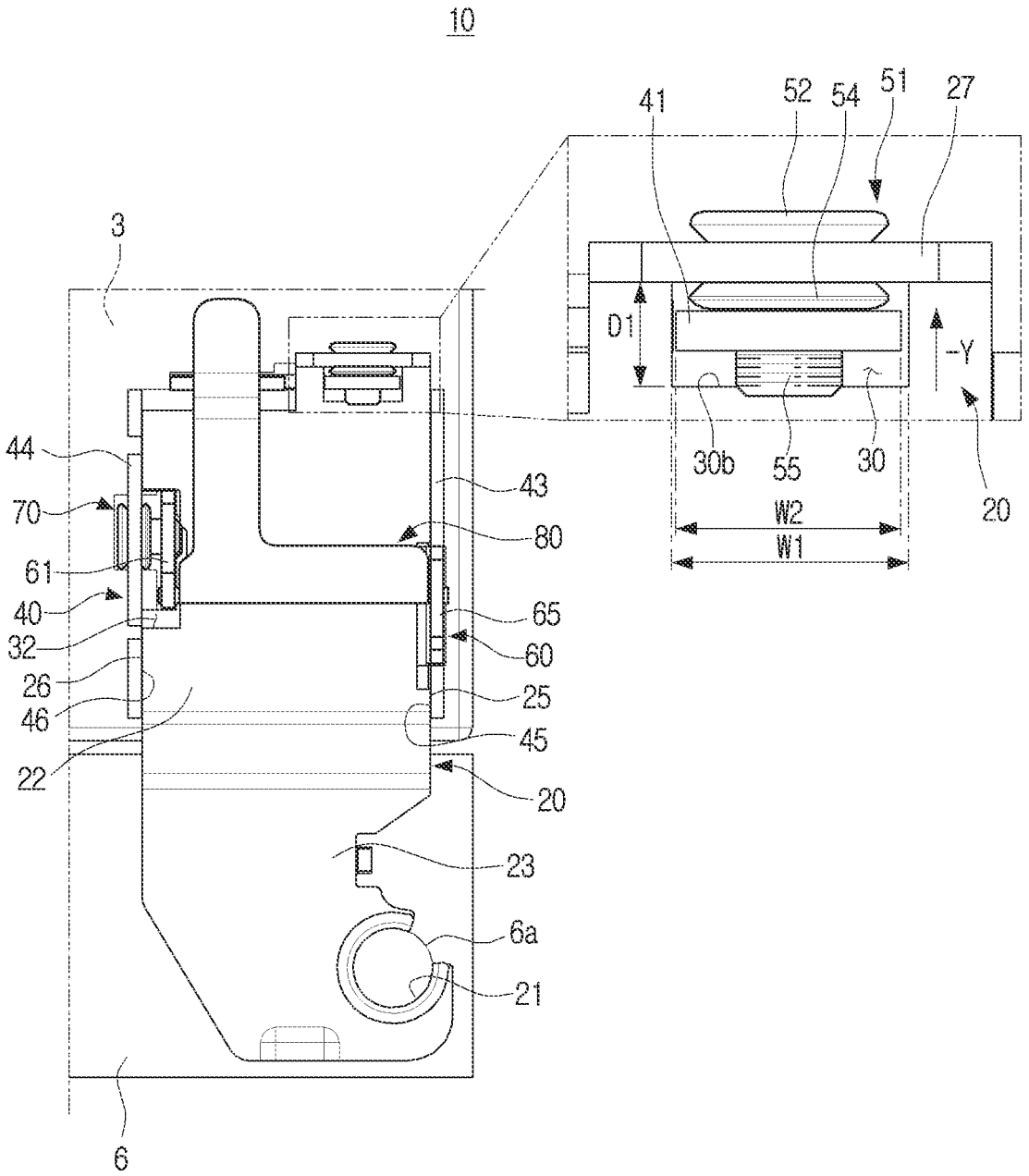
FIG. 5B is a plan view illustrating a state in which an upper moving part of the hinge of FIG. 5A is moved in a first direction.

FIG. 5A is a plan view illustrating a hinge according to an embodiment, and FIG. 5B is a plan view illustrating a state in which an upper moving part of the hinge of FIG. 5A is moved in a first direction.

Referring to FIG. 5A, a bottom surface 30*b* of the upper avoidance opening 30 of the upper moving part 20 is in contact with the front surface of the upper fixing portion 41 of the lower moving part 40. In this state, when the upper adjustment bolt 51 is rotated in one direction, the threaded portion 55 of the upper adjustment bolt 51 is moved in the Y direction with respect to the upper bolt hole 42 of the upper fixing portion 41.

Because the upper hooking portion 27 of the upper moving part 20 is inserted into the engaging groove 57 of the upper adjustment bolt 51, when the upper adjustment bolt 51 moves in the Y direction, the upper hooking portion 27 is moved in the Y direction together with the upper adjustment bolt 51. Because the upper hooking portion 27 is formed integrally with the upper moving part 20, when the upper adjustment bolt 51 moves, the upper moving part 20 moves together in the Y direction. In other words, when the upper adjustment bolt 51 is rotated in one direction, the upper moving part 20 is moved in the Y direction.

The pair of upper slide surfaces 25 and 26 are formed on both side surfaces of the upper moving part 20, and the pair of upper guide portions 45 and 46 corresponding to the pair of upper slide surfaces 25 and 26 are formed on the lower moving part 40. Therefore, the movement of the upper moving part 20 in the Y direction is guided by the pair of upper slide surfaces 25 and 26 of the upper moving part 20 and the pair of upper guide portions 45 and 46 of the lower moving part 40. Because the pair of upper slide surfaces 25 and 26 of the upper moving part 20 and the pair of upper guide portions 45 and 46 of the lower moving part 40 are formed to be parallel to each other, when the upper adjustment bolt 51 is rotated in one direction, the upper moving part 20 may be linearly moved in the Y direction with respect to the lower moving part 40.

When the upper adjustment bolt 51 is rotated to the maximum in one direction, the intermediate ring 54 of the upper adjustment bolt 51 comes in contact with the rear surface of the upper fixing portion 41 of the lower moving part 40 as illustrated in FIG. 5B. In this state, the upper moving part 20 may no longer move in the Y direction.

When the upper adjustment bolt 51 is rotated in the opposite direction in the state of FIG. 5B, the upper adjustment bolt 51 may be moved in the −Y direction with respect to the upper fixing portion 41. At this time, the upper moving part 20 is moved in the −Y direction together with the upper adjustment bolt 51.

When the upper adjustment bolt 51 is rotated to the maximum in the opposite direction, the bottom surface 30*b* of the upper avoidance opening 30 of the upper moving part 20 comes into contact with the front surface of the upper fixing portion 41 as illustrated in FIG. 5A. When this state is reached, the upper moving part 20 may no longer move in the −Y direction.

Accordingly, the user may rotate the upper adjustment bolt 51 to move the door 6 coupled to the hinge shaft 21 of the upper moving part 20 in the Y direction.

Figure 6A:
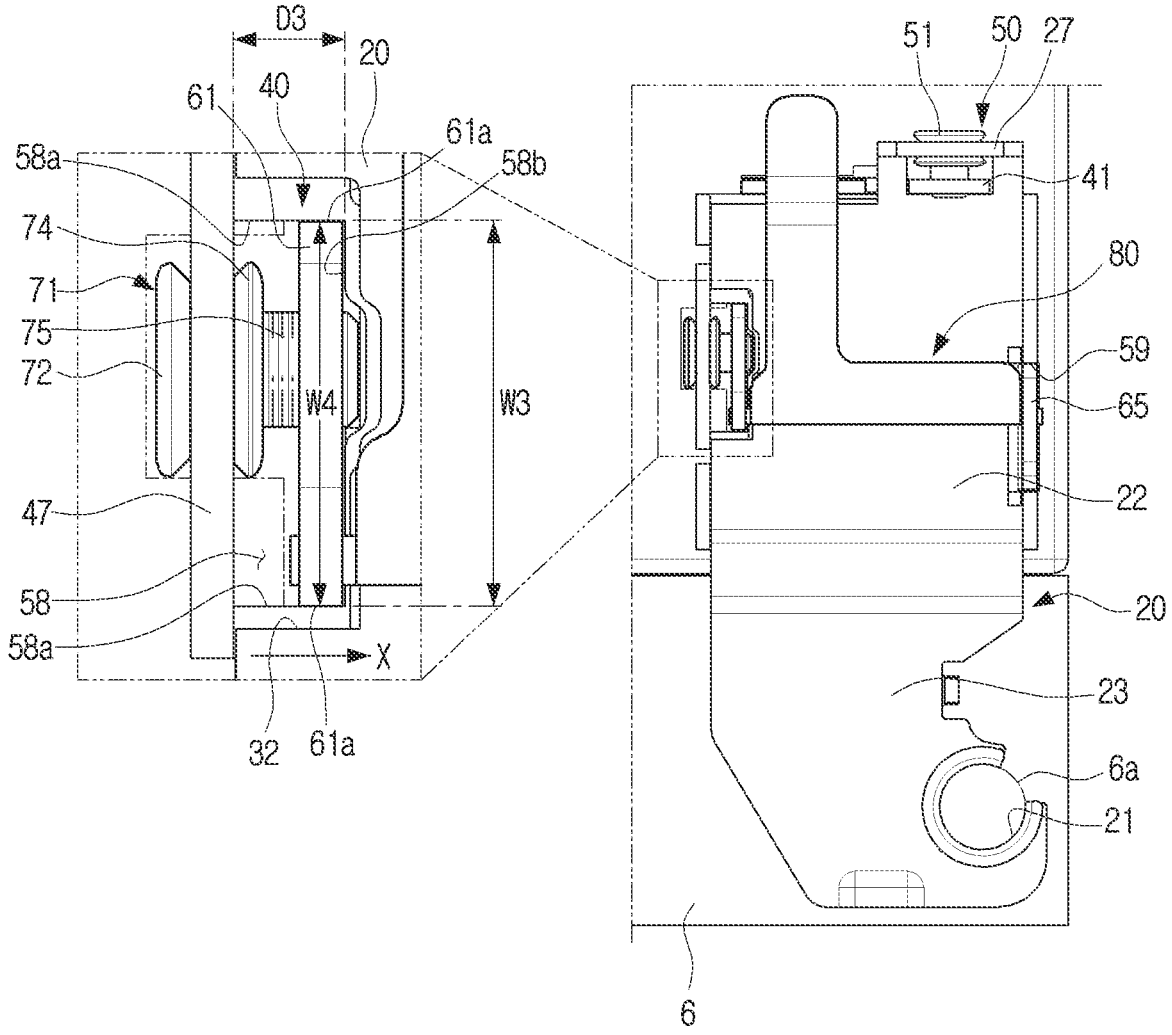
FIG. 6A is a plan view illustrating a hinge according to an embodiment.
Figure 6B:
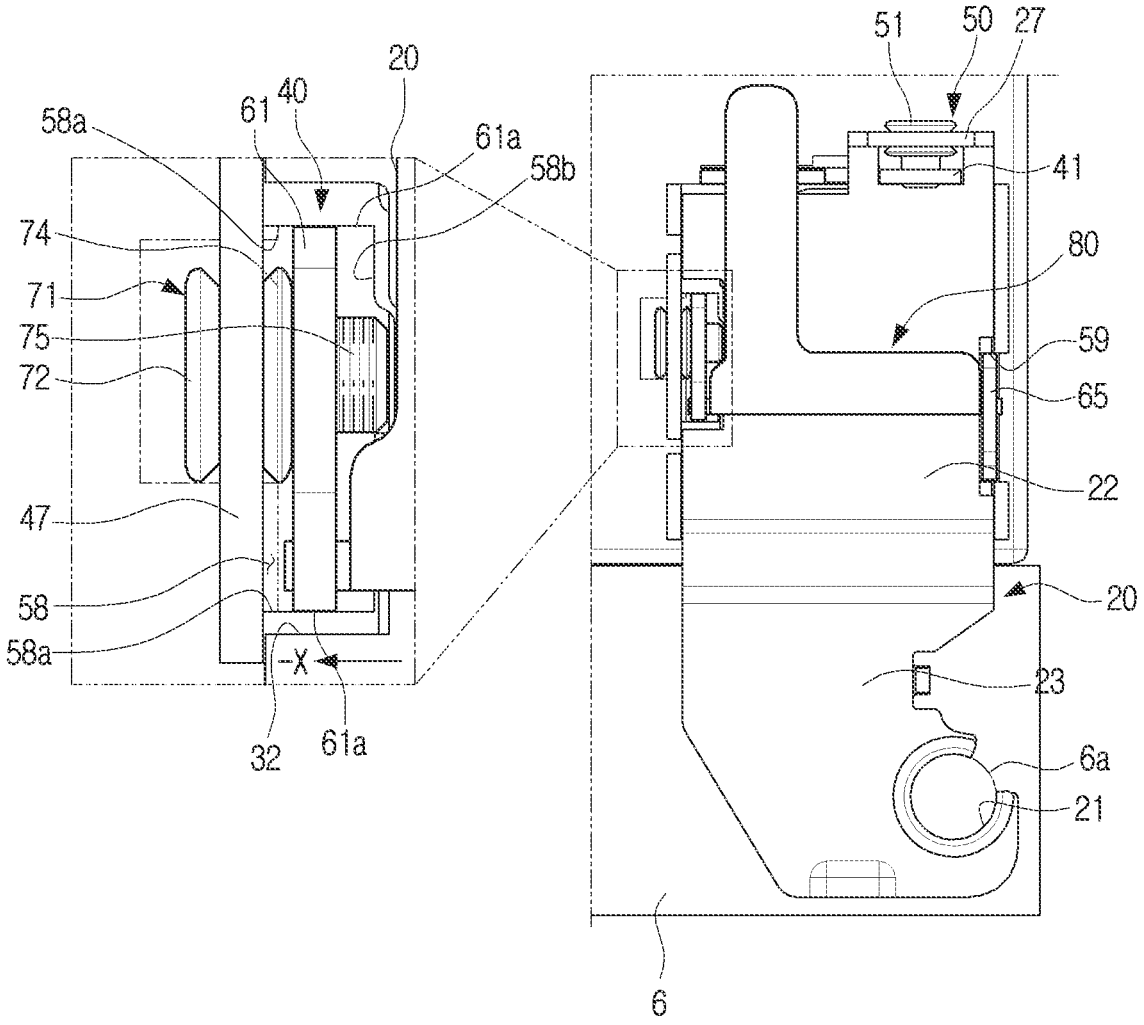
FIG. 6B is a plan view illustrating a state in which a lower moving part of the hinge of FIG. 6A is moved in a second direction.

FIG. 6A is a plan view illustrating a hinge according to an embodiment, and FIG. 6B is a plan view illustrating a state in which a lower moving part of the hinge of FIG. 6A is moved in a second direction.

Referring to FIG. 6A, the bottom surface 58*b* of the lower avoidance opening 58 of the lower moving part 40 is in contact with the front surface of the lower fixing portion 61 of the fixing part 60. In this state, when the lower adjustment bolt 71 is rotated in one direction, the threaded portion 75 of the lower adjustment bolt 71 is moved in the X direction with respect to the bolt hole 62 of the lower fixing portion 61.

Because the lower hooking portion 47 of the lower moving part 40 is inserted into the engaging groove 77 of the lower adjustment bolt 71, when the lower adjustment bolt 71 moves in the X direction, the lower hooking portion 47 is moved in the X direction together with the lower adjustment bolt 71. Because the lower hooking portion 47 is formed integrally with the lower moving part 40, when the lower adjustment bolt 71 moves, the lower moving part 40 moves together in the X direction. In other words, when the lower adjustment bolt 71 is rotated in one direction, the lower moving part 40 is moved in the X direction.

The pair of lower slide surfaces 58*a* are formed on both inner side surfaces of the lower avoidance opening 58 of the lower moving part 40, and the pair of lower sub-slide surfaces 59*a* are formed on both inner side surfaces of the guide opening 59. The fixing part 60 is provided with the pair lower guide portions 61*a* corresponding to the pair of the lower slide surfaces 58*a* and the pair of lower sub-guide portions 65*a* corresponding to the pair of lower sub-slide surfaces 59*a*. Accordingly, the movement of the lower moving part 40 in the X direction is guided by the pair of lower slide surfaces 58*a* and the lower sub-slide surfaces 59*a* of the lower moving part 40 and the pair of lower guide portions 61*a* and the pair of lower sub-guide portions 65*a* of the fixing part 60. Because the pair of lower slide surfaces 58*a* and the lower sub-slide surfaces 59*a* of the lower moving part 40 and the pair of lower guide portions 61*a* and the pair of lower sub-guide portions 65*a* of the fixing part 60 are formed in parallel to each other, when the lower adjustment bolt 71 is rotated in one direction, the lower moving part 40 may be linearly moved in the X direction with respect to the fixing part 60.

Because the upper moving part 20 is disposed on the upper surface of the lower moving part 40, when the lower moving part 40 is moved in the X direction by the lower adjustment bolt 71, the upper moving part 20 is also moved in the X direction together with the lower moving part 40.

When the lower adjustment bolt 71 is rotated to the maximum in one direction, the intermediate ring 74 of the lower adjustment bolt 71 comes into contact with the rear surface of the lower fixing portion 61 as illustrated in FIG. 6B. In this state, the lower moving part 40 may no longer move in the X direction.

When the lower adjustment bolt 71 is rotated in the opposite direction in the state of FIG. 6B, the lower adjustment bolt 71 may be moved in the opposite direction with respect to the lower fixing portion 61, that is, in the −X direction. At this time, the lower moving part 40 is moved in the −X direction together with the lower adjustment bolt 71.

When the lower adjustment bolt 71 is rotated to the maximum in the opposite direction, the bottom surface 58*b* of the lower avoidance opening 58 of the lower moving part 40 comes into contact with the front surface of the lower fixing portion 61 as illustrated in FIG. 6A. When this state is reached, the lower moving part 40 may no longer move in the −X direction.

Accordingly, the user may rotate the lower adjustment bolt 71 to move the door 6 coupled to the hinge shaft 21 of the upper moving part 20 in the X direction.

Therefore, the left door and the right door disposed in a refrigerator using a hinge according to an embodiment of the disclosure may adjust a level difference and a gap therebetween.

Figure 7:
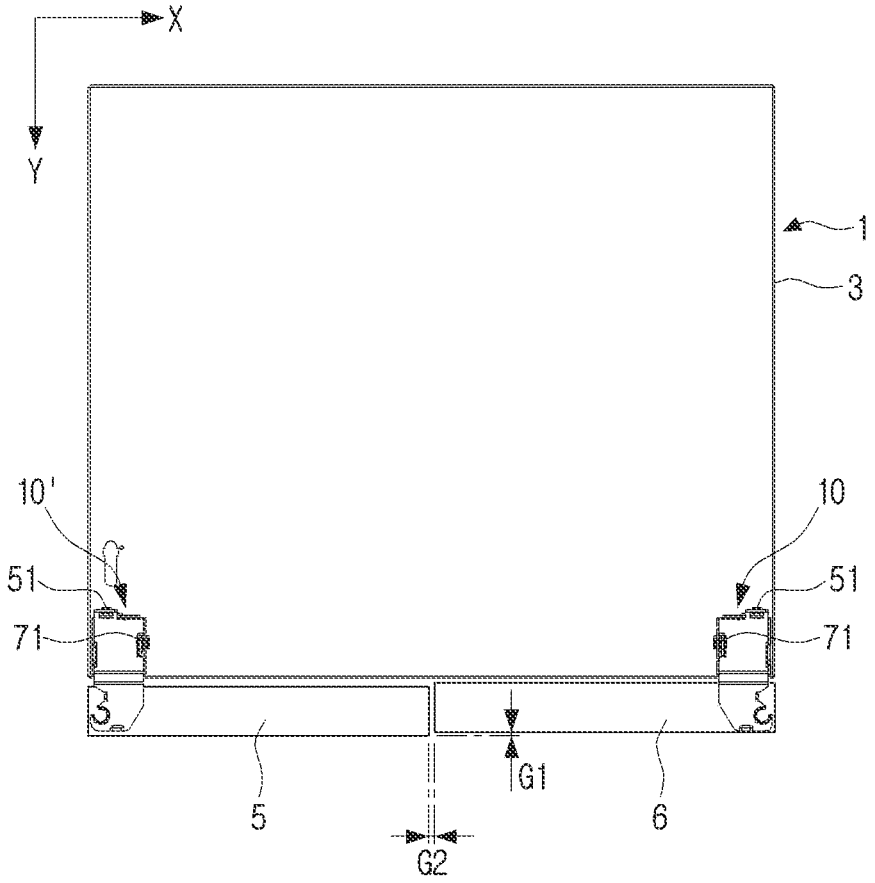
FIG. 7 is a view for explaining a method of adjusting a level difference and a gap between a left door and a right door using a hinge according to an embodiment.

FIG. 7 is a view for explaining a method of adjusting a level difference and a gap between a left door and a right door using a hinge according to an embodiment.

Referring to FIG. 7, when any one of the left hinge 10' supporting the left door 5 and the right hinge 10 supporting the right door 6 is moved in the Y direction, the left door 5 and the right door 6 may be adjusted so that there is no level difference between the left door 5 and the right door 6. In other words, by adjusting the upper adjustment bolt 51 of the left hinge 10' or the right hinge 10, the level difference G1 between the left door 5 and the right door 6 may be made zero (0). For example, when the upper adjustment bolt 51 of the right hinge 10 is rotated so that the right door 6 is moved in the Y direction, the front surface of the right door 6 may form a single plane with the front surface of the left door 5.

In addition, when any one of the left hinge 10' supporting the left door 5 and the right hinge 10 supporting the right door 6 is moved in the X direction, the left door 5 and the right door 6 may be adjusted so that the gap G2 between the left door 5 and the right door 6 is uniform. In other words, when the lower adjustment bolt 71 of the left hinge 10' or the right hinge 10 is adjusted, the gap G1 between the left door 5 and the right door 6 may be made to be constant in the height direction of the refrigerator 1. For example, when the lower adjustment bolt 71 of the right hinge 10 is rotated so that the right door 6 is moved in the X direction, the gap G2 between the side surface of the right door 6 and the side surface of the left door 5 may be adjusted to be uniform.

Hereinafter, a refrigerator according to another embodiment of the disclosure will be described in detail with reference to FIG. 8.

Figure 8:
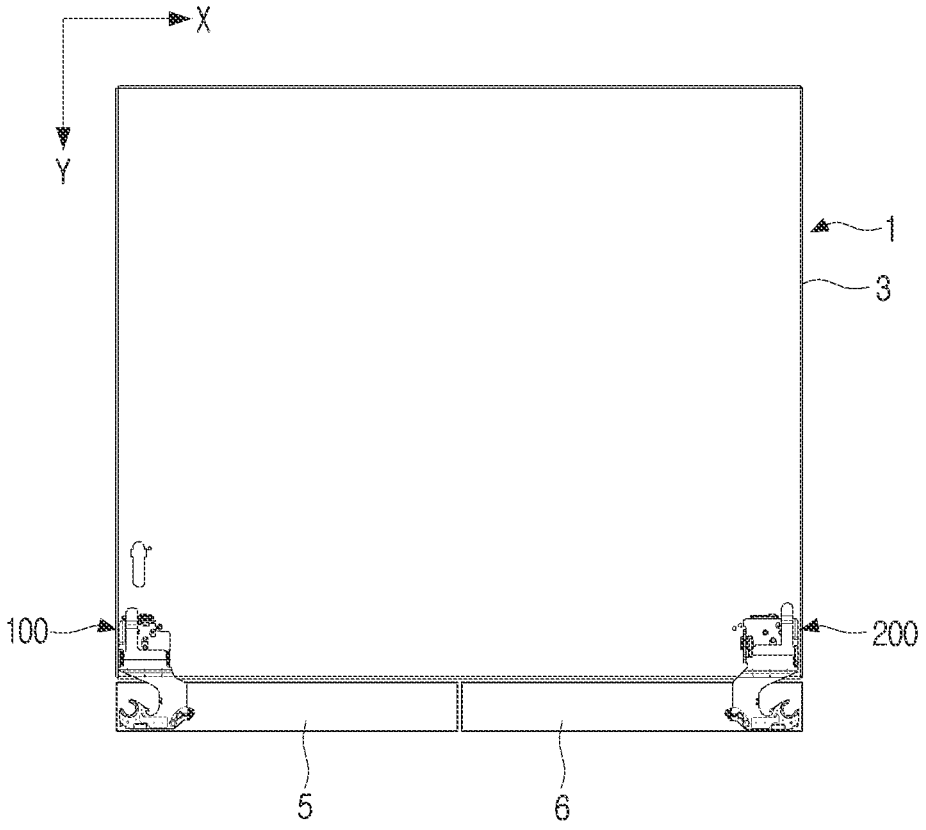
FIG. 8 is a plan view illustrating a refrigerator according to another embodiment.

FIG. 8 is a plan view illustrating a refrigerator according to another embodiment.

Referring to FIG. 8, a refrigerator 1 according to an embodiment of the disclosure may include a cabinet 3 and a pair of doors 5 and 6.

The cabinet 3 forms the appearance of the refrigerator 1. The interior space of the cabinet 3 may be divided into a freezer compartment and a refrigerator compartment.

The pair of doors, that is, a left door 5 and a right door 6 may be disposed in the front surface of the cabinet 3.

The upper and lower ends of each of the left door 5 and the right door 6 may be supported by hinges 100 and 200, so that each of the left door 5 and the right door 6 may be opened and closed with respect to the front surface of the cabinet 3.

A left hinge 100 may be disposed on the left side of the upper surface of the cabinet 3 to support the left door 5 so that the left door 5 is rotated with respect to the cabinet 3. In other words, the left hinge 100 may allow the left door 5 to be opened and closed with respect to the front surface of the cabinet 3. In addition, the left hinge 100 may be formed to move the left door 5 in a direction (Y direction) perpendicular to the front surface of the cabinet 3.

A right hinge 200 may be disposed on the right side of the upper surface of the cabinet 3 to support the right door 6 so that the right door 6 is rotated with respect to the cabinet 3. In other words, the right hinge 200 may allow the right door 6 to be opened and closed with respect to the front surface of the cabinet 3. In addition, the right hinge 200 may be formed to move the right door 6 in a direction (X direction) parallel to the front surface of the cabinet 3.

Hereinafter, the left hinge 100 will be described in detail with reference to FIGS. 9 and 10.

Figure 9:
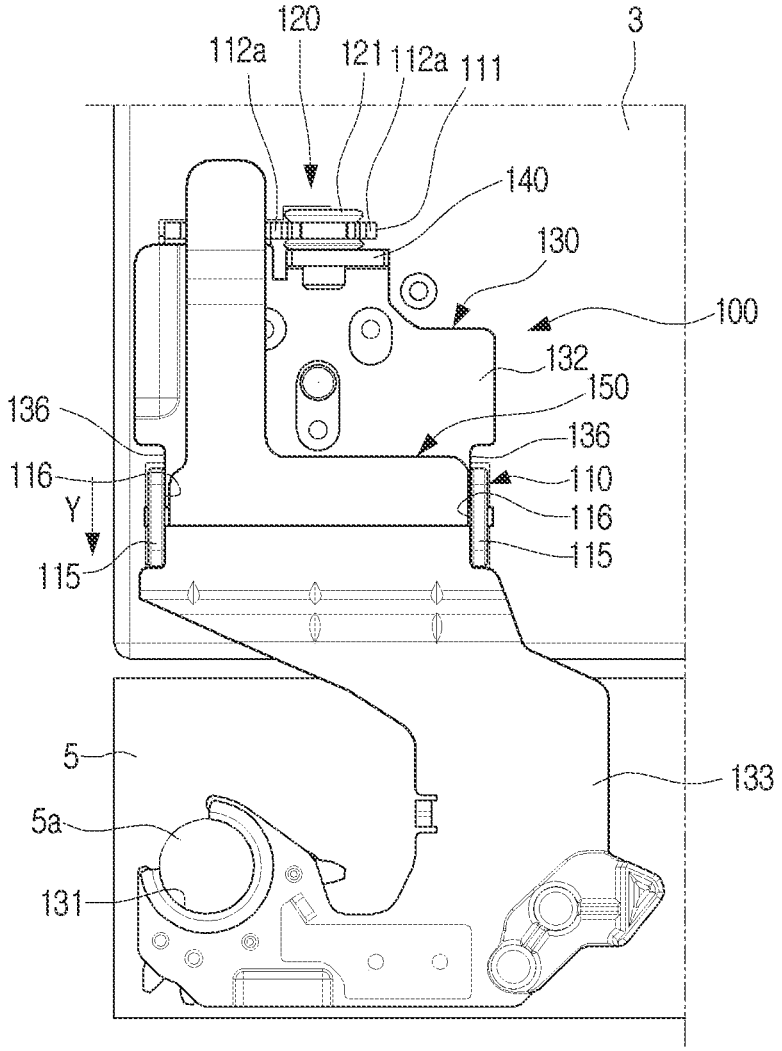
FIG. 9 is a plan view illustrating a left hinge of the refrigerator of FIG. 8.
Figure 10:
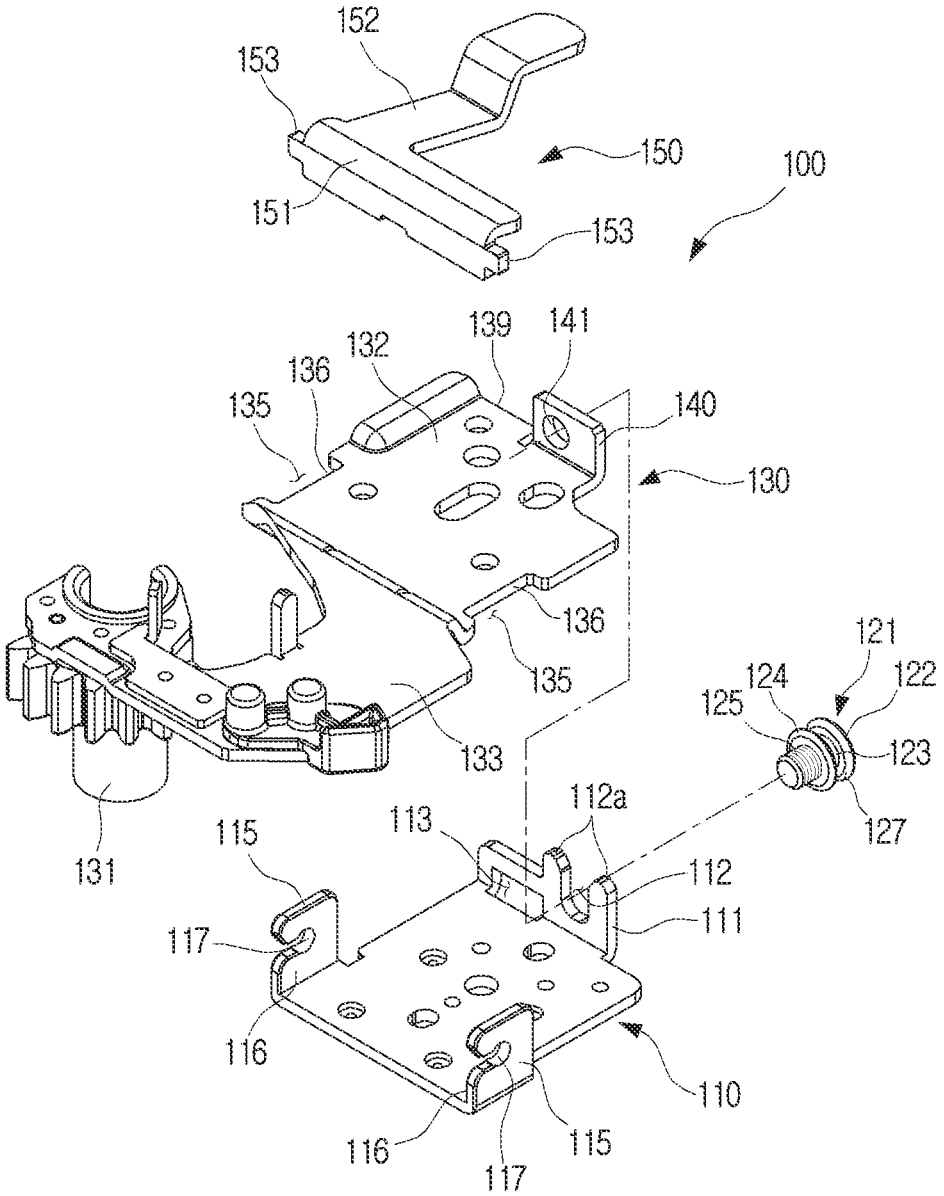
FIG. 10 is an exploded perspective view illustrating the left hinge of FIG. 9.

FIG. 9 is a plan view illustrating a left hinge of the refrigerator of FIG. 8, and FIG. 10 is an exploded perspective view illustrating the left hinge of FIG. 9.

Referring to FIGS. 9 and 10, the left hinge 100 may include a left fixing part 110 and a vertical moving part 130.

The left fixing part 110 may be fixed to the cabinet 3 and may support the vertical moving part 130 so that the vertical moving part 130 may move. In other words, the left fixing part 110 may be disposed under the vertical moving part 130 and may be fixed to the upper surface of the cabinet 3.

The left fixing part 110 may include a vertical adjustment member 120 configured to move the vertical moving part 130 in a direction perpendicular to the front surface of the cabinet 3 (hereinafter referred to as a vertical direction) (arrow Y). The left fixing part 110 may guide the vertical moving part 130 to linearly move in the vertical direction.

The left fixing part 110 may be formed in an approximately rectangular flat plate. A vertical fixing portion 111 may extend vertically from one end of the left fixing part 110. The vertical fixing portion 111 may be provided with a vertical groove 112 in which a vertical adjustment bolt 121 is disposed.

The vertical groove 112 may be formed at the upper end of the vertical fixing portion 111, and both sidewalls 112*a* of the vertical groove 112 may be inserted into an engaging groove 127 of the vertical adjustment bolt 121 so that the vertical adjustment bolt 121 may rotate with respect to the vertical fixing portion 111. Accordingly, the vertical adjustment bolt 121 may rotate with respect to the vertical groove 112 of the vertical fixing portion 111 without moving back and forth, left and right with respect to the left fixing part 110. The vertical fixing portion 111 may be formed at one end of the left fixing part 110 in the direction in which the vertical moving part 130 moves.

The vertical adjustment bolt 121 may include a head 122, a body 123, and an intermediate ring 124. The vertical adjustment bolt 121 may be formed in the same manner as the upper adjustment bolt 51 and the lower adjustment bolt 71 of the above-described embodiment, and thus a detailed description thereof is omitted. The engaging groove 127 into which the vertical fixing portion 111 of the left fixing part 110 is inserted may be formed between the head 122 and the intermediate ring 124 of the vertical adjustment bolt 121.

An insertion opening 113 into which an insertion protrusion 139 of the vertical moving part 130 is inserted may be formed at one side of the vertical groove 112 in the vertical fixing portion 111. The width of the insertion opening 113 may be formed larger than the width of the insertion protrusion 139. Therefore, when the vertical moving part 130 moves in the vertical direction, the insertion protrusion 139 does not interfere with the insertion opening 113 of the left fixing part 110.

A pair of support portions 115 may be formed on both side surfaces of the left fixing part 110 perpendicular to the vertical fixing portion 111. The pair of support portions 115 may extend vertically from both side surfaces of the left fixing part 110. The pair of support portions 115 may be formed to face each other in parallel. The vertical moving part 130 may be disposed between the pair of support portions 115.

The inner surfaces of the pair of support portions 115 facing each other may form guide surfaces 116 that guide the vertical moving part 130. Accordingly, the pair of guide surfaces 116 of the left fixing part 110 may guide the linear movement of the vertical moving part 130.

A rotation groove 117 into which a rotation protrusion 153 of a hinge clamp 150 is inserted may be formed on one side surface of each of the pair of support portions 115. The hinge clamp 150 may rotate based on the pair of rotation grooves 117.

The vertical moving part 130 may be coupled to the left door 5, and may be formed to move in the vertical direction (arrow Y) with respect to the cabinet 3. One end of the vertical moving part 130 may be provided with a cylindrical hinge shaft 131 coupled to the left door 5. A hinge hole 5*a* into which the hinge shaft 131 is inserted may be provided at the upper end of the left door 5. Accordingly, because the left door 5 may rotate at a predetermined angle based on the hinge shaft 131, the left door 5 may selectively open and close the left side of the front surface of the cabinet 3.

The vertical moving part 130 may be disposed on the upper side of the left fixing part 110 fixed to the cabinet 3, and may be formed to move linearly in the vertical direction with respect to the cabinet 3. The vertical moving part 130 may be formed of a flat plate, and may include a vertical slide portion 132 that is in contact with the left fixing part 110 and slides with respect to the left fixing part 110 and a vertical hinge portion 133 in which the hinge shaft 131 is disposed. The vertical hinge portion 133 may be formed by being bent to have a predetermined level difference with respect to the vertical slide portion 132. The vertical slide portion 132 and the vertical hinge portion 133 may be formed to be parallel to each other. The hinge shaft 131 may be disposed perpendicular to the vertical hinge portion 133.

The vertical slide portion 132 may be formed in a substantially rectangular flat plate. A pair of vertical slide surfaces 136 may be formed on both side surfaces of the vertical slide portion 132 of the vertical moving part 130. The pair of vertical slide surfaces 136 may be formed to be parallel to each other on both side surfaces of the vertical slide portion 132, and may be in contact with the left fixing part 110 when the vertical slide portion 132 moves linearly in one direction with respect to the left fixing part 110. The pair of vertical slide surfaces 136 may be formed as bottom surfaces of a pair of moving grooves 135 formed on both side surfaces of the vertical slide portion 132. Accordingly, the vertical moving part 130 may include the pair of vertical slide surfaces 136 formed in parallel in a direction perpendicular to the front surface of the cabinet 3.

A vertical connection portion 140 of the vertical moving part 130 may be formed at one end of the vertical slide portion 132. The vertical connection portion 140 may be formed at one end of the vertical slide portion 132 facing the hinge shaft 131. The vertical connection portion 140 may extend vertically from one end of the vertical slide portion 132 of the vertical moving part 130, and may include a bolt hole 141 into which the male thread 125 of the vertical adjustment bolt 121 is fastened. A female thread corresponding to the male thread 125 of the vertical adjustment bolt 121 may be formed on the inner surface of the bolt hole 141.

Therefore, when the vertical moving part 130 is disposed on the left fixing part 110 so that the pair of support portions 115 of the left fixing part 110 are inserted into the pair of moving grooves 135 of the vertical moving part 130, the vertical connection portion 140 of the vertical moving part 130 faces the vertical fixing portion 111 of the left fixing part 110. In this state, after the engaging groove 127 of the vertical adjustment bolt 121 is coupled to the insertion groove 112 of the vertical fixing portion 111, the male thread 125 of the vertical adjustment bolt 121 may be fastened to the bolt hole 141 of the vertical connection portion 140 of the vertical moving part 130. When the vertical adjustment bolt 121 is rotated in this state, the vertical moving part 130 may be moved in the longitudinal direction of the vertical adjustment bolt 121, that is, in the Y direction. Depending on the rotation direction of the vertical adjustment bolt 121, the vertical moving part 130 may approach the vertical fixing portion 111 of the left fixing part 110 or move away from the vertical fixing portion 111.

The vertical fixing portion 111 and the vertical adjustment bolt 121 provided on the left fixing part 110 may form the vertical adjustment member 120 capable of moving the vertical moving part 130 in the vertical direction.

The left fixing part 110 may include a pair of vertical guide surfaces 116 for guiding the pair of vertical slide surfaces 136 of the vertical moving part 130 so that the vertical moving part 130 linearly moves in the vertical direction. The pair of the vertical guide surfaces 116 may be formed as the inner surfaces of the pair of support portions 115 formed on both side surfaces of the left fixing part 110.

The vertical moving part 130 may be disposed between the pair of support portions 115 on the upper surface of the left fixing part 110, and may move along the pair of support portions 115. In other words, the pair of support portions 115 of the left fixing part 110 may be formed in a direction perpendicular to the front surface of the cabinet 3, and may face the pair of vertical slide surfaces 136 of the vertical moving part 130.

The left hinge 100 may further include a hinge clamp 150. The hinge clamp 150 may be formed to fix the vertical moving part 130 to the left fixing part 110.

The hinge clamp 150 may include a pressing portion 151 and a handle 152. A pair of rotation protrusions 153 may be provided at both ends of the pressing portion 151. The pair of rotation protrusions 153 may be formed to be inserted into a pair of rotation grooves 117 of the pair of support portions 115 of the left fixing part 110. Accordingly, the pressing portion 151 may rotate based on the pair of rotation protrusions 153 inserted into the pair of rotation grooves 117 of the left fixing part 110. The lower end of the pressing portion 151 may be formed to press the upper surface of the vertical moving part 130.

The handle 152 may extend approximately vertically from the pressing portion 151. The user may rotate the pressing portion 151 while holding the handle 152.

When the lower end of the pressing portion 151 presses the upper surface of the vertical moving part 130, the vertical moving part 130 is fixed to the left fixing part 110 and does not move. When the lower end of the pressing portion 151 does not contact the upper surface of the vertical moving part 130, the vertical moving part 130 may be moved by the vertical adjustment member 120.

Hereinafter, the operation of the left hinge 100 will be described in detail with reference to FIGS. 11A and 11B.

Figure 11A:
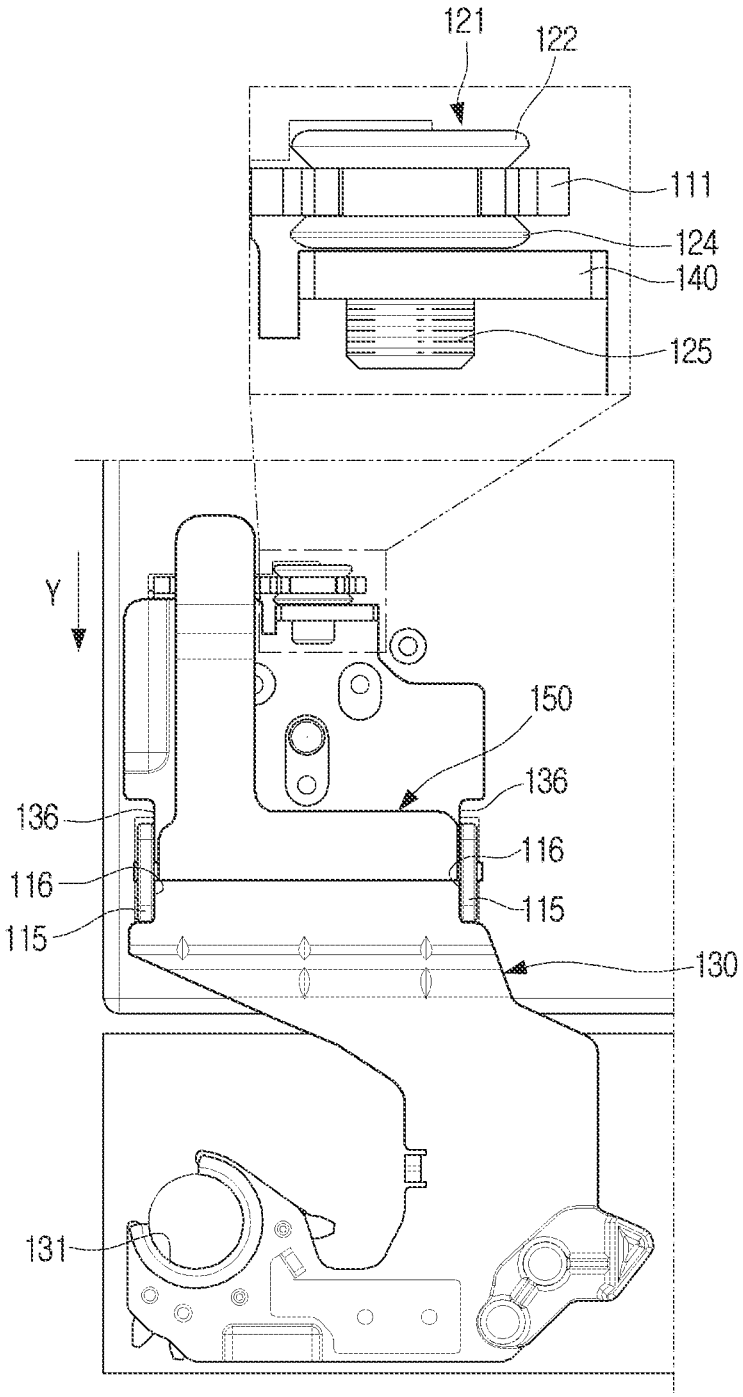
FIG. 11A is a view for explaining an operation of a vertical moving part of a left hinge.
Figure 11B:
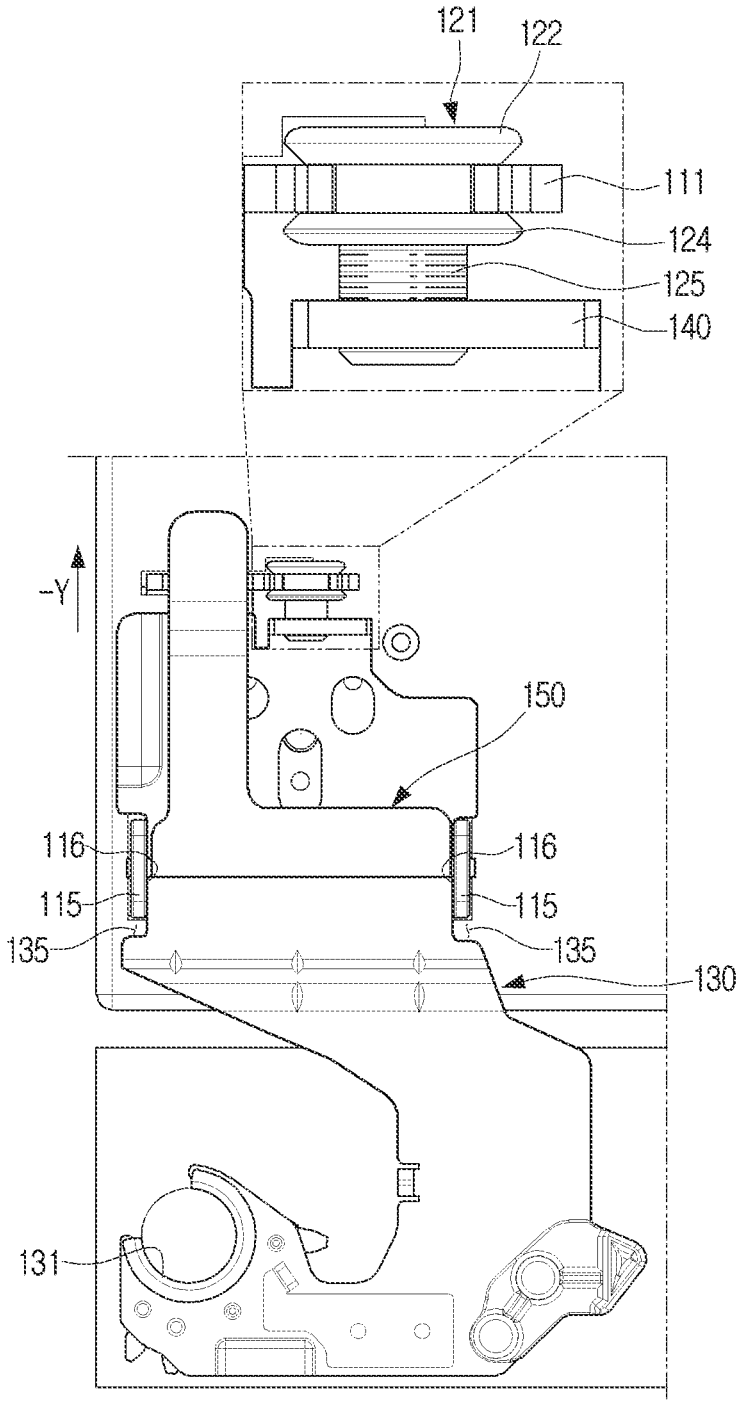
FIG. 11B is a view for explaining an operation of a vertical moving part of a left hinge.

FIGS. 11A and 11B are views for explaining an operation of a vertical moving part of a left hinge.

Referring to FIG. 11A, the rear surface of the vertical connection portion 140 of the vertical moving part 130 is in contact with the intermediate ring 124 of the vertical adjustment bolt 121 coupled to the vertical fixing portion 111 of the left fixing part 110. In this state, when the vertical adjustment bolt 121 is rotated in one direction, the vertical connection portion 140 fastened to the threaded portion 125 of the vertical adjustment bolt 121 is moved in the longitudinal direction of the vertical adjustment bolt 121, that is, in the Y direction. Because the vertical connection portion 140 is integrally formed with the vertical moving part 130, when the vertical connection portion 140 is moved, the vertical moving part 130 is moved along with the vertical connection portion 140 in the Y direction. In other words, when the vertical adjustment bolt 121 is rotated in one direction, the vertical moving part 130 is moved in the Y direction.

The pair of vertical slide surfaces 136 are formed on both side surfaces of the vertical moving part 130, and the pair of vertical guide surfaces 116 corresponding to the pair of vertical slide surfaces 136 are provided in the left fixing part 110. Accordingly, the Y-direction movement of the vertical moving part 130 is guided by the pair of vertical slide surfaces 136 of the vertical moving part 130 and the pair of vertical guide surfaces 116 of the left fixing part 110. Because the pair of vertical slide surfaces 136 of the vertical moving part 130 and the pair of vertical guide surfaces 116 of the left fixing part 110 are formed to be parallel to each other, when the vertical adjustment bolt 121 is rotated in one direction, the vertical moving part 130 may be linearly moved in the Y direction with respect to the left fixing part 110.

When the vertical adjustment bolt 121 is rotated to the maximum in one direction, one inner side surface of each of the pair of moving grooves 135 of the vertical moving part 130 comes into contact with each of the pair of the support portions 115 of the left fixing part 110 as illustrated in FIG. 11B. In this state, the vertical moving part 130 may no longer move in the Y direction.

When the vertical adjustment bolt 121 is rotated in the opposite direction in the state of FIG. 11B, the vertical moving part 130 coupled to the vertical adjustment bolt 121 may be moved in the −Y direction with respect to the left fixing part 110.

When the vertical adjustment bolt 121 is rotated to the maximum in the opposite direction, the rear surface of the vertical connection portion 140 of the vertical moving part 130 comes into contact with the intermediate ring 124 of the vertical adjustment bolt 121 as illustrated in FIG. 11A. When this state is reached, the vertical moving part 130 may no longer move in the −Y direction.

Accordingly, the user may rotate the vertical adjustment bolt 121 to move the left door 5 coupled to the hinge shaft 131 of the vertical moving part 130 in the Y direction.

Hereinafter, the right hinge 200 will be described in detail with reference to FIGS. 12 and 13.

Figure 12:
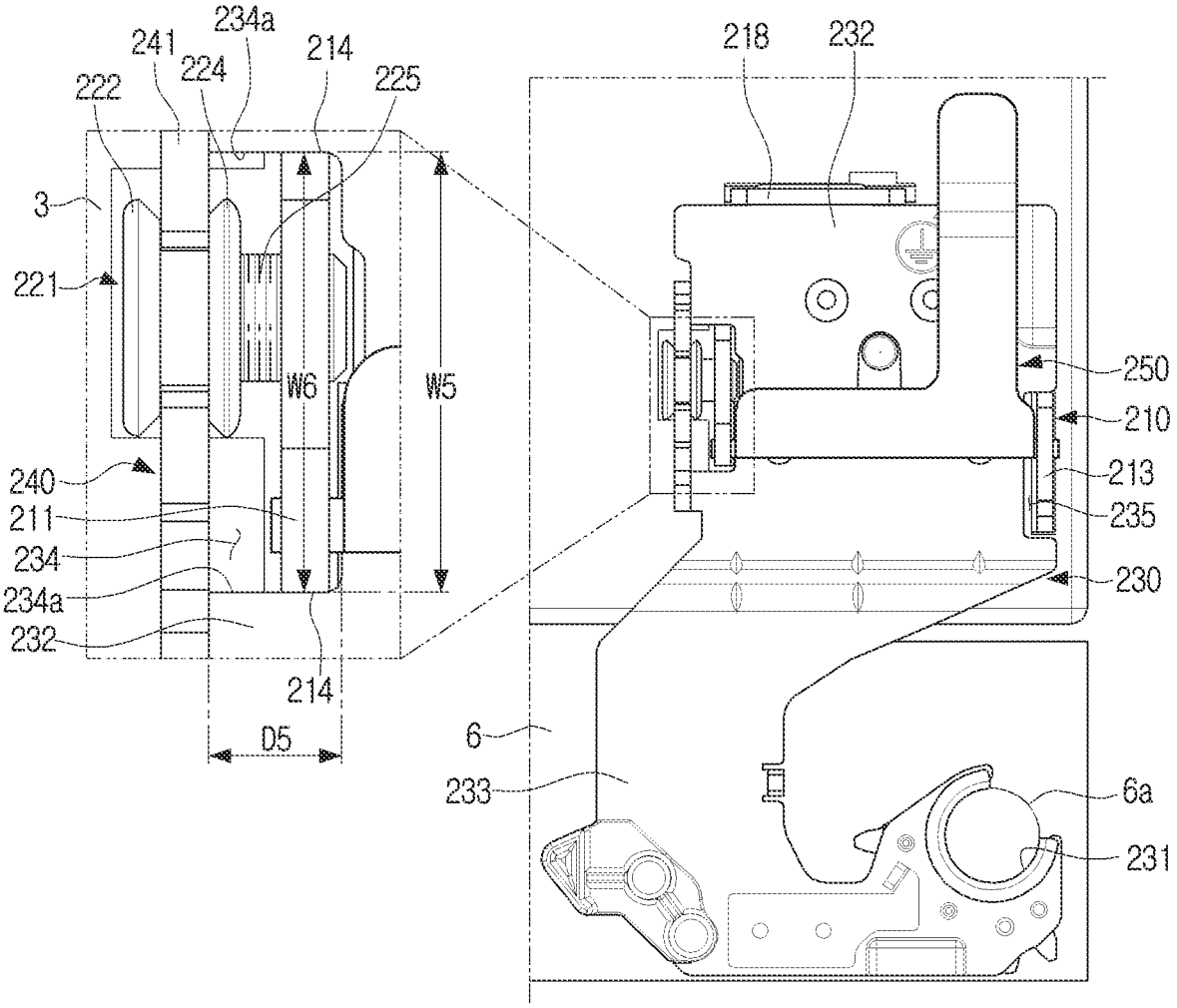
FIG. 12 is a plan view illustrating a right hinge of the refrigerator of FIG. 8.
Figure 13:
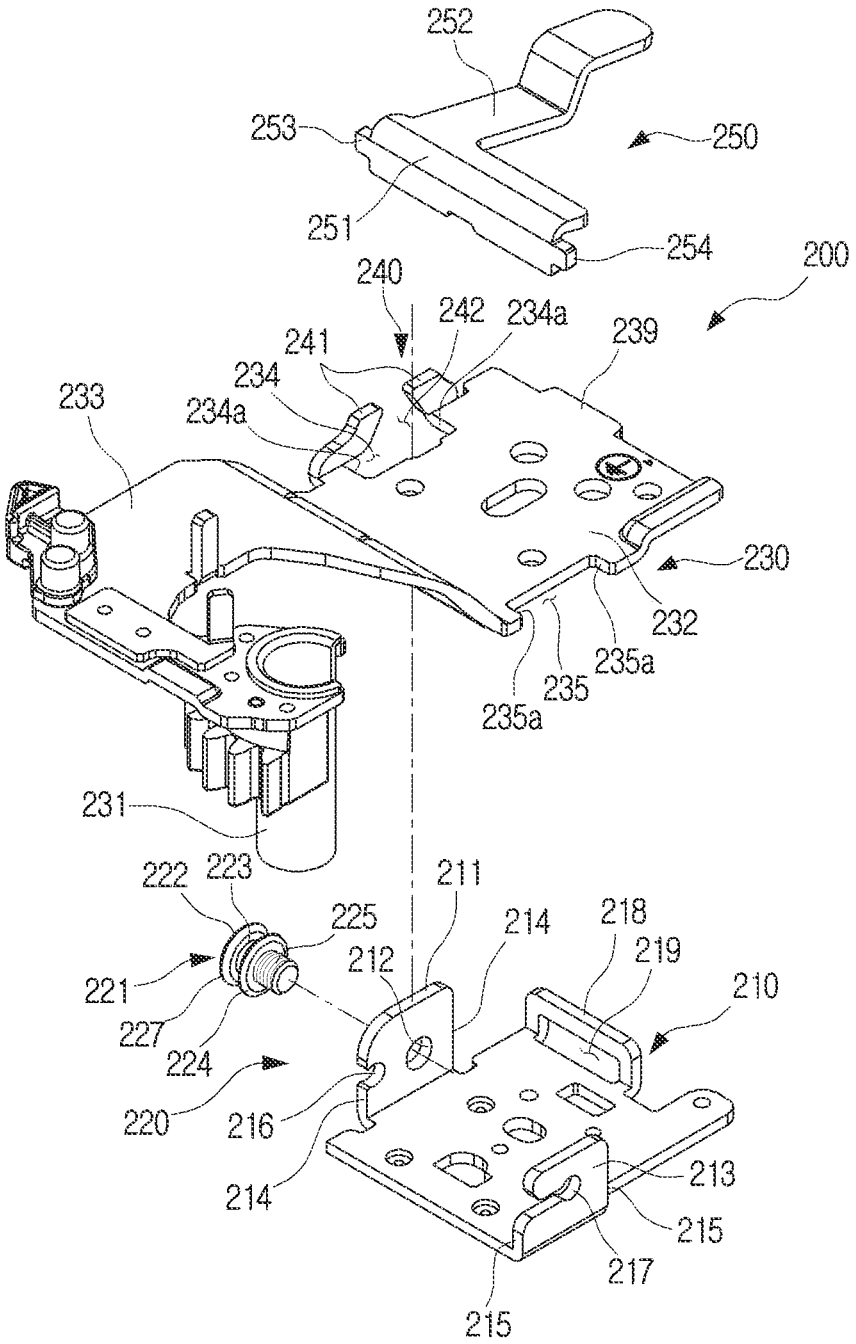
FIG. 13 is an exploded perspective view illustrating the right hinge of FIG. 12.

FIG. 12 is a plan view illustrating a right hinge of the refrigerator of FIG. 8, and FIG. 13 is an exploded perspective view illustrating the right hinge of FIG. 12.

Referring to FIGS. 12 and 13, the right hinge 200 may include a right fixing part 210 and a horizontal moving part 230.

The right fixing part 210 may be fixed to the cabinet 3 and may support the horizontal moving part 230 so that the horizontal moving part 230 may move. In other words, the right fixing part 210 may be disposed under the horizontal moving part 230 and may be fixed to the upper surface of the cabinet 3.

The right fixing part 210 may include a horizontal adjustment member 220 configured to move the horizontal moving part 230 in a direction parallel to the front surface of the cabinet 3 (hereinafter referred to as a horizontal direction), that is, in the X direction. The right fixing part 210 may guide the horizontal moving part 230 to linearly move in the horizontal direction.

The right fixing part 210 may be formed in an approximately rectangular flat plate. A horizontal fixing portion 211 may extend vertically from one end of the right fixing part 210. The horizontal fixing portion 211 may be provided with a bolt hole 212 into which a horizontal adjustment bolt 221 is fastened. A female thread is formed in the bolt hole 212 of the horizontal fixing portion 211. The horizontal fixing portion 211 may be formed at one end of the right fixing part 210 in the direction in which the horizontal moving part 230 moves. A first rotation groove 216 into which a first rotation protrusion 253 of a hinge clamp 250 is inserted may be formed on one side surface of the horizontal fixing portion 211.

The horizontal adjustment bolt 221 may include a head 222, a body 223, and an intermediate ring 224. The horizontal adjustment bolt 221 may be formed in the same manner as the upper adjustment bolt 51 and the lower adjustment bolt 71 of the hinge 10 of the above-described embodiment, and thus a detailed description thereof is omitted. An engaging groove 227 into which the horizontal hooking portion of the horizontal moving part 230 is inserted may be formed between the head 222 and the intermediate ring 224 of the horizontal adjustment bolt 221.

The horizontal fixing portion 211 and the horizontal adjustment bolt 221 provided on the right fixing part 210 may form the horizontal adjustment member capable of moving the horizontal moving part 230 in the horizontal direction.

The right fixing part 210 may include a support portion 213. The support portion 213 may extend vertically from the other end of the right fixing part 210 and may be formed to face the horizontal fixing portion 211. A second rotation groove 217 into which a second rotation protrusion 254 of the hinge clamp 250 is inserted may be provided on one side surface of the support portion 213. The horizontal moving part 230 may be disposed between the horizontal fixing portion 211 and the support portion 213 on the right fixing part 210.

A fixing wall 218 may be formed on one side surface of the right fixing part 210, that is, on one side surface of the right fixing part 210 perpendicular to the horizontal fixing portion 211. The fixing wall 218 may extend vertically from one side surface of the right fixing part 210. An insertion groove 219 into which an insertion protrusion 239 of the horizontal moving part 230 is inserted may be formed at a lower portion of the fixing wall 218. The width of the insertion groove 219 may be formed larger than the width of the insertion protrusion 239. Accordingly, when the horizontal moving part 230 moves in the horizontal direction, the insertion protrusion 239 does not interfere with the insertion groove 219 of the right fixing part 210.

The right fixing part 210 may include a pair of horizontal guide portions 214 for guiding a pair of horizontal slide surfaces 234*a* of the horizontal moving part 230 so that the horizontal moving part 230 linearly moves in the horizontal direction. The pair of horizontal guide portions 214 of the right fixing part 210 may be formed as both side surfaces of the horizontal fixing portion 211 extending vertically from one end of the right fixing part 210.

In addition, the right fixing part 210 may further include a pair of horizontal sub-guide portions 215. The pair of horizontal sub-guide portions 215 may be formed as both side surfaces of the support portion 213 extending vertically from the other end of the right fixing part 210. Both side surfaces of the support portion 213 may be formed to slide in contact with both inner side surfaces of the guide opening 235 of the horizontal moving part 230, that is, a pair of horizontal sub-slide surfaces 235*a*.

The horizontal moving part 230 may be coupled to the right door 6, and may be formed to move in the horizontal direction with respect to the cabinet 3. A hinge shaft 231 having a cylindrical shape coupled to the right door 6 may be provided at one end of the horizontal moving part 230. A hinge hole 6*a* into which the hinge shaft 231 is inserted may be provided at the upper end of the right door 6. Accordingly, because the right door 6 may rotate at a predetermined angle based on the hinge shaft 231, the right door 6 may selectively open and close the right side of the front surface of the cabinet 3.

The horizontal moving part 230 may be disposed on the upper side of the right fixing part 210 fixed to the cabinet 3, and may be formed to move linearly in a direction parallel to the cabinet 3. The horizontal moving part 230 may be formed of a flat plate, and may include a horizontal slide portion 232 that is in contact with the right fixing part 210 and slides with respect to the right fixing part 210 and a horizontal hinge portion 233 in which the hinge shaft 231 is disposed.

The horizontal hinge portion 233 may be formed by being bent to have a predetermined level difference with respect to the horizontal slide portion 232. The horizontal slide portion 232 and the horizontal hinge portion 233 may be formed to be parallel to each other. The hinge shaft 231 may be disposed perpendicular to the horizontal hinge portion 233.

The horizontal moving part 230 may include a horizontal hooking portion 240. The horizontal hooking portion 240 of the horizontal moving part 230 may be formed at one end of the horizontal moving part 230. The horizontal hooking portion 240 may be formed at one end of the horizontal moving part 230 adjacent to the horizontal fixing portion 211 of the right fixing part 210.

The horizontal hooking portion 240 may be formed in two hooking arms 241 extending vertically from one end of the horizontal moving part 230. The two hooking arms 241 may be spaced apart from each other by a predetermined distance, and may be formed to be inclined at a predetermined angle to form an approximate isosceles triangle. The upper portions of the two hooking arms 241 are inserted into the engaging groove 227 of the horizontal adjustment bolt 221 to fix the horizontal adjustment bolt 221 so that the horizontal adjustment bolt 221 does not move in the longitudinal direction. An opening 242 into which the head 222 of the horizontal adjustment bolt 221 is inserted may be provided under the two hooking arms 241.

In addition, an avoidance opening 234 into which the horizontal fixing portion 211 of the right fixing part 210 is inserted may be provided in the horizontal slide portion 232 of the horizontal moving part 230 in front of the horizontal hooking portion 240. The avoidance opening 234 may be formed in a rectangular shape.

The width W5 of the avoidance opening 234 of the horizontal moving part 230 may be formed to have a size corresponding to the width W6 of the horizontal fixing portion 211 of the right fixing part 210. For example, the width W5 of the avoidance opening 234 may be determined so that the both inner side surfaces of the avoidance opening 234, that is, the pair of horizontal slide surfaces 234*a* may slide in contact with the both side surfaces of the horizontal fixing portion 211, that is, the pair of horizontal guide portions 214.

The depth D5 of the avoidance opening 234 may be formed to have a size corresponding to a moving distance of the horizontal moving part 230 in the horizontal direction. Accordingly, the distance in which the horizontal moving part 230 moves in the horizontal direction may be limited by the depth D5 of the avoidance opening 230.

Therefore, after inserting the horizontal hooking portion 240 of the horizontal moving part 230 into the engaging groove 227 of the horizontal adjustment bolt 221 of the right fixing part 210, turning the horizontal adjustment bolt 221, the horizontal moving part 230 may be moved in the horizontal direction with respect to the right fixing part 210.

In detail, when the horizontal adjustment bolt 221 is rotated in a state in which the horizontal hooking portion 240 of the horizontal moving part 230 is inserted into the engaging groove 227 of the horizontal adjustment bolt 221 of the right fixing part 210, the horizontal hooking portion 240 is linearly moved by the horizontal adjustment bolt 221. Because the horizontal hooking portion 240 is formed integrally with the horizontal moving part 230, when the horizontal hooking portion 240 is moved, the horizontal moving part 230 is moved with respect to the right fixing part 210.

The horizontal moving part 230 may include the pair of horizontal slide surfaces 234*a* formed in parallel in the horizontal direction. The pair of horizontal slide surfaces 234*a* may be formed to guide the horizontal moving part 230 to linearly move in the horizontal direction. The pair of horizontal slide surfaces 234*a* may be formed as both inner side surfaces of the avoidance opening 234 of the horizontal moving part 230.

In addition, the pair of horizontal slide surfaces 234*a* may further include a pair of horizontal sub-slide surfaces 235*a* formed on both inner side surfaces of a guide opening 235 formed at the other end of the horizontal moving part 230. The guide opening 235 of the horizontal moving part 230 may be formed so that the support portion 213 of the right fixing part 210 is inserted into the guide opening 235. The width of the guide opening 235 may be formed to have a size corresponding to the width of the support portion 213 of the right fixing part 210. For example, the width of the guide opening 235 may be determined so that both inner side surfaces of the guide opening 235, that is, the pair of horizontal sub-slide surfaces 235*a* may slide in contact with both side surfaces of the support portion 213, that is, the pair of horizontal sub-guide portions 215.

The right hinge 200 may further include the hinge clamp 250. The hinge clamp 250 may be formed to fix the horizontal moving part 230 to the right fixing part 210.

The hinge clamp 250 may include a pressing portion 251 and a handle 252. A pair of rotation protrusions, that is, a first rotation protrusion 253 and a second rotation protrusion 254 may be provided at both ends of the pressing portion 251. The first rotation protrusion 253 may be formed to be inserted into the first rotation groove 216 of the horizontal fixing portion 211 of the right fixing part 210, and the second rotation protrusion 254 may be formed to be inserted into the second rotation groove 217 of the support portion 213. Accordingly, the pressing portion 251 may rotate based on the first and second rotation protrusions 253 and 254 inserted into the first and second rotation grooves 216 and 217 of the right fixing part 210. The lower end of the pressing portion 251 may be formed to press the upper surface of the horizontal moving part 230.

The handle 252 may extend approximately vertically from the pressing portion 251. The user may rotate the pressing portion 251 while holding the handle 252.

When the lower end of the pressing portion 251 presses the upper surface of the horizontal moving part 230, the horizontal moving part 230 is fixed to the right fixing part 210, and thus does not move. When the lower end of the pressing portion 251 does not contact the upper surface of the horizontal moving part 230, the horizontal moving part 230 may be moved by the horizontal adjusting member 220.

Hereinafter, the operation of the right hinge 200 will be described in detail with reference to FIGS. 14A and 14B.

Figure 14A:
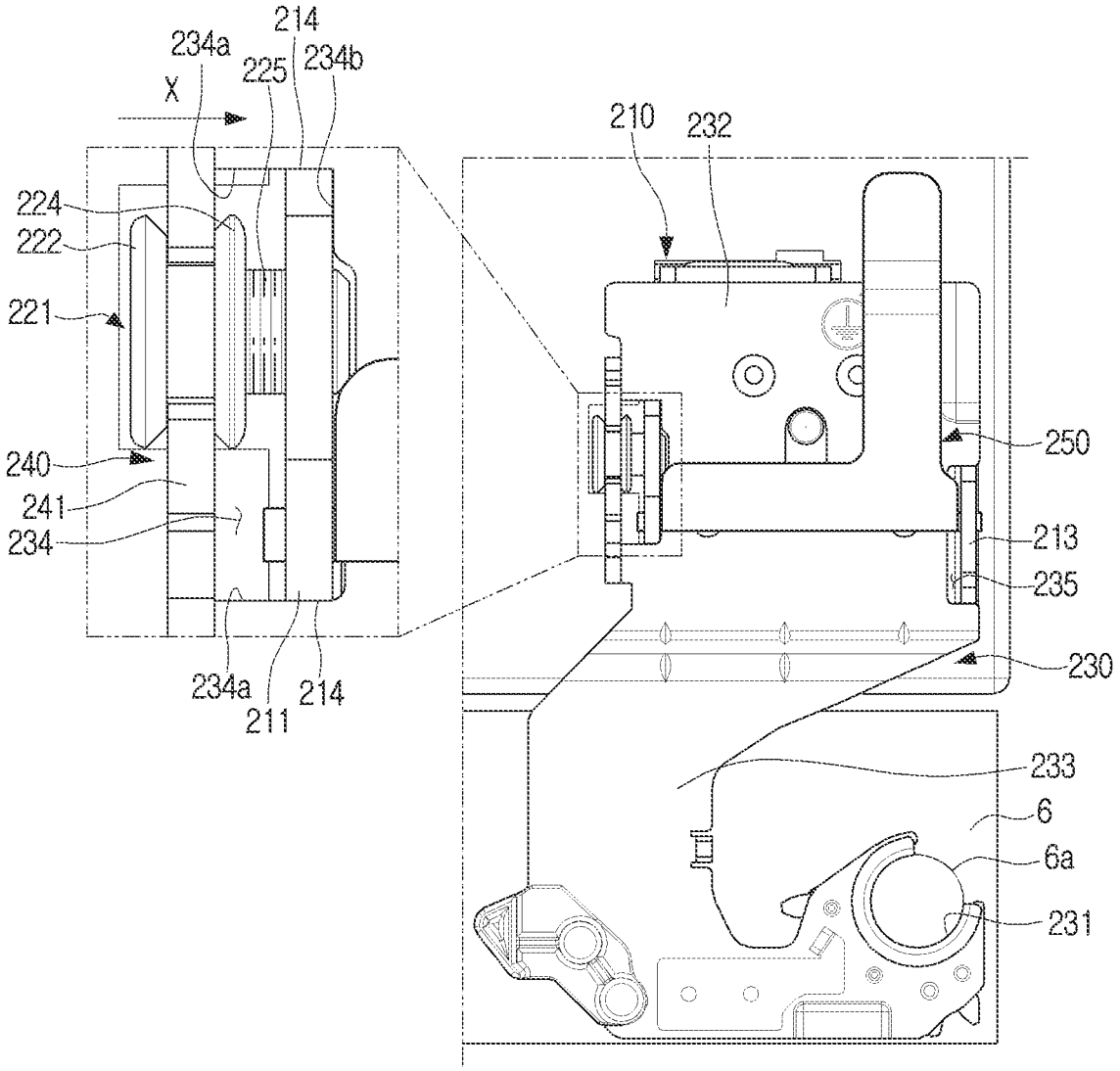
FIG. 14A is a view for explaining an operation of a horizontal moving part of a right hinge.
Figure 14B:
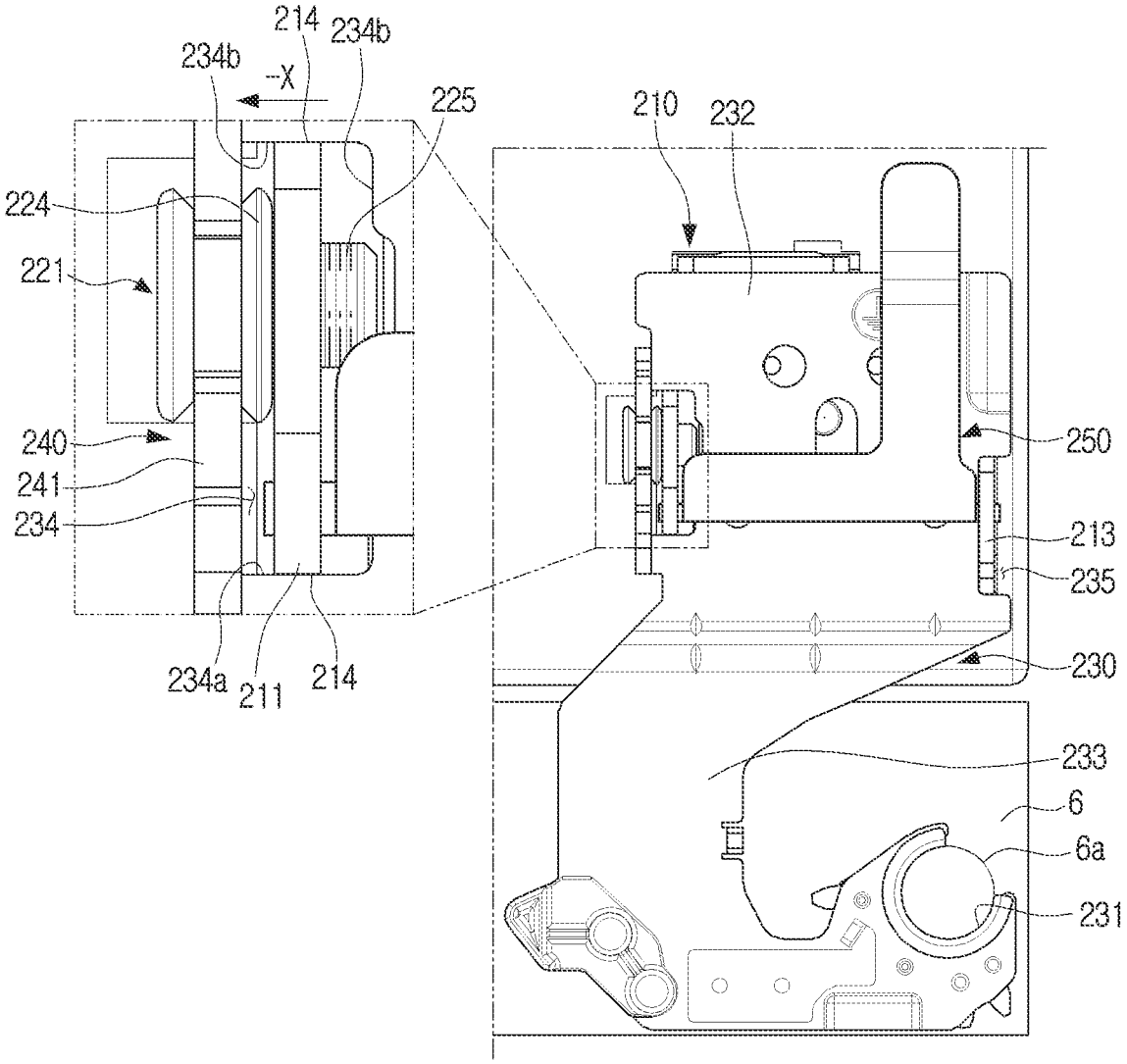
FIG. 14B is a view for explaining an operation of a horizontal moving part of a right hinge.

FIGS. 14A and 14B are views for explaining an operation of a horizontal moving part of a right hinge.

Referring to FIG. 14A, the bottom surface 234*b* of the avoidance opening 234 of the horizontal moving part 230 is in contact with the front surface of the horizontal fixing portion 211 of the right fixing part 210. In this state, when the horizontal adjustment bolt 221 is rotated in one direction, the threaded portion 225 of the horizontal adjustment bolt 221 is moved in the X direction with respect to the bolt hole 212 of the horizontal fixing portion 211.

Because the horizontal hooking portion 240 of the horizontal moving part 230 is inserted into the engaging groove 227 of the horizontal adjustment bolt 221, when the horizontal adjustment bolt 221 moves in the X direction, the horizontal hooking portion 240 is moved in the X direction together with the horizontal adjustment bolt 221. Because the horizontal hooking portion 240 is formed integrally with the horizontal moving part 230, when the horizontal adjustment bolt 221 moves, the horizontal moving part 230 moves together in the X direction. In other words, when the horizontal adjustment bolt 221 is rotated in one direction, the horizontal moving part 230 is moved in the X direction.

The pair of horizontal slide surfaces 234*a* are formed on both inner side surfaces of the avoidance opening 234 of the horizontal moving part 230, and the pair of horizontal sub-slide surfaces 235*a* are formed on both inner side surfaces of the guide opening 235. The right fixing part 210 is provided with the pair of horizontal guide portions 214 corresponding to the pair of the horizontal slide surfaces 234*a* and the pair of horizontal sub-guide portions 215 corresponding to the pair of horizontal sub-slide surfaces 235*a*. Accordingly, the X-direction movement of the horizontal moving part 230 is guided by the pair of horizontal slide surfaces 234*a* and the horizontal sub-slide surfaces 235*a* of the horizontal moving part 230 and the pair of horizontal guide portions 214 and the pair of horizontal sub-guide portions 215 of the right fixing part 210. Because the pair of horizontal slide surfaces 234*a* and the horizontal sub-slide surfaces 235*a* of the horizontal moving part 230 and the pair of horizontal guide portions 214 and the pair of horizontal sub-guide portions 215 of the right fixing part 210 are formed in parallel to each other, when the horizontal adjustment bolt 221 is rotated in one direction, the horizontal moving part 230 may be linearly moved in the X direction with respect to the right fixing part 210.

When the horizontal adjustment bolt 221 is rotated to the maximum in one direction, the intermediate ring 224 of the horizontal adjustment bolt 221 comes into contact with the rear surface of the horizontal fixing portion 211 as illustrated in FIG. 14B. In this state, the horizontal moving part 230 may no longer move in the X direction.

When the horizontal adjustment bolt 221 is rotated in the opposite direction in the state of FIG. 14B, the horizontal adjustment bolt 221 may be moved in the opposite direction with respect to the horizontal fixing portion 211, that is, in the −X direction. At this time, the horizontal moving part 230 is moved in the −X direction together with the horizontal adjustment bolt 221.

When the horizontal moving part 230 is rotated to the maximum in the opposite direction, the bottom surface 234*b* of the avoidance opening 234 of the horizontal moving part 230 comes into contact with the front surface of the horizontal fixing portion 211 as illustrated in FIG. 14A. When this state is reached, the horizontal moving part 230 may no longer move in the −X direction.

Accordingly, the user may rotate the horizontal adjustment bolt 221 to move the right door 6 coupled to the hinge shaft 231 of the horizontal moving part 230 in the X direction.

As described above, in the refrigerator 1 according to this embodiment, the level difference between the left door 5 and the right door 6 may be removed by adjusting the vertical adjustment bolt 121 of the left hinge 100 that may move the left door 5 in a direction perpendicular to the front surface of the cabinet 3. In addition, the gap between the left door 5 and the right door 6 may be adjusted by using the horizontal adjustment bolt 221 of the right hinge 200 that may move the right door 6 in a direction parallel to the front surface of the cabinet 3.

Hereinafter, a refrigerator according to another embodiment of the disclosure will be described in detail with reference to FIG. 15.

Figure 15:
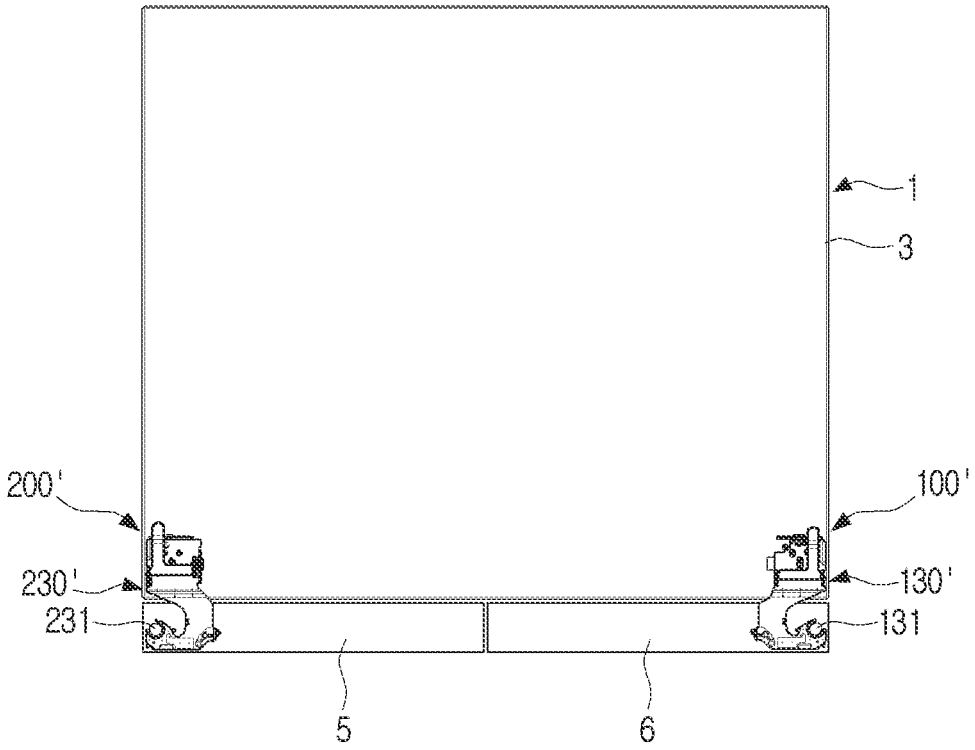
FIG. 15 is a plan view illustrating a refrigerator according to another embodiment.

FIG. 15 is a plan view illustrating a refrigerator according to another embodiment.

Referring to FIG. 15, a refrigerator 1 according to an embodiment of the disclosure may include a cabinet 3 and a pair of doors 5 and 6.

The cabinet 3 forms the appearance of the refrigerator 1. The interior space of the cabinet 3 may be divided into a freezer compartment and a refrigerator compartment.

The pair of doors, that is, a left door 5 and a right door 6, may be disposed in the front surface of the cabinet 3.

The upper and lower ends of each of the left door 5 and the right door 6 may be supported by hinges, so that each of the left door 5 and the right door 6 may be opened and closed with respect to the front surface of the cabinet 3.

A left hinge 200' may be disposed on the left side of the upper surface of the cabinet 3 to support the left door 5 so that the left door 5 is rotated with respect to the cabinet 3. In other words, the left hinge 200' may allow the left door 5 to be opened and closed with respect to the front surface of the cabinet 3. In addition, the left hinge 200' may be formed to move the left door 5 in a direction (X direction) parallel to the front surface of the cabinet 3.

A right hinge 100' may be disposed on the right side of the upper surface of the cabinet 3 to support the right door 6 so that the right door 6 is rotated with respect to the cabinet 3. In other words, the right hinge 100' may allow the right door 6 to be opened and closed with respect to the front surface of the cabinet 3. In addition, the right hinge 100' may be formed to move the right door 6 in a direction (Y direction) perpendicular to the front surface of the cabinet 3.

Hereinafter, the left hinge 200' will be described in detail with reference to FIG. 16.

Figure 16:
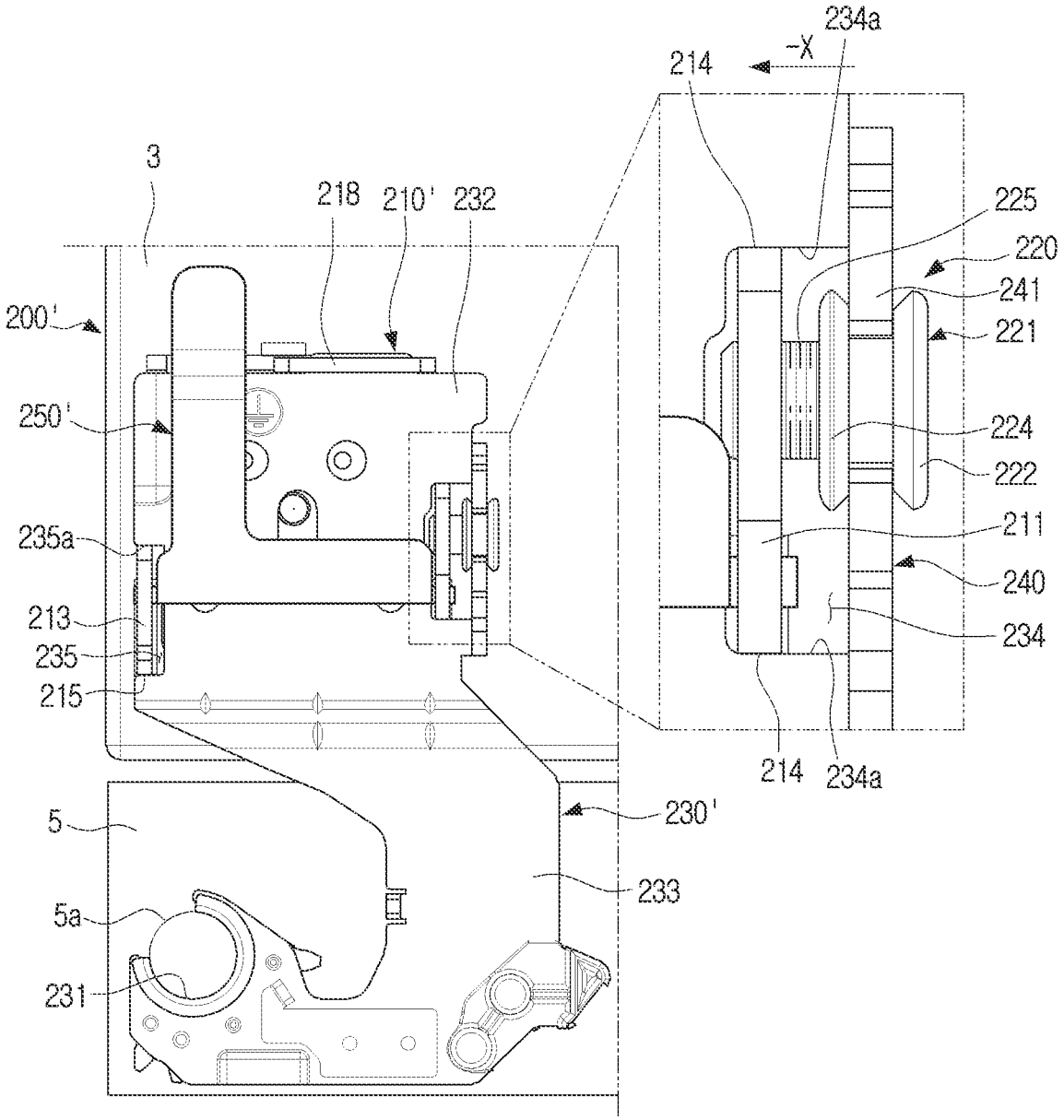
FIG. 16 is a plan view illustrating a left hinge of the refrigerator of FIG. 15.

FIG. 16 is a plan view illustrating a left hinge of the refrigerator of FIG. 15.

Referring to FIG. 16, the left hinge 200' may include a left fixing part 210' and a horizontal moving part 230'.

The left fixing part 210' may be fixed to the cabinet 3 and may support the horizontal moving part 230' so that the horizontal moving part 230' may move. In other words, the left fixing part 210' may be disposed under the horizontal moving part 230' and may be fixed to the upper surface of the cabinet 3.

The left fixing part 210' may include a horizontal adjustment member 220 configured to move the horizontal moving part 230' in a direction parallel to the front surface of the cabinet 3 (hereinafter referred to as a horizontal direction), that is, in the X direction. The left fixing part 210' may guide the horizontal moving part 230' to linearly move in the horizontal direction.

The left fixing part 210' may be formed in an approximately rectangular flat plate. Like the right fixing part 210 of the above-described embodiment, the left fixing part 210' may have a horizontal fixing portion 211, a horizontal adjustment bolt 221, a support portion 213, a fixing wall 218, a pair of horizontal guide portions 214, and a pair of horizontal sub-guide portions 215. However, the left fixing part 210' according to this embodiment is different from the right fixing part 210 according to the above-described embodiment in a line-symmetric relationship.

The horizontal moving part 230' may be coupled to the left door 5 and may be formed to move in the horizontal direction with respect to the cabinet 3. A hinge shaft 231 having a cylindrical shape coupled to the left door 5 may be provided at one end of the horizontal moving part 230'. A hinge hole 5*a* into which the hinge shaft 231 is inserted may be provided at the upper end of the left door 5. Accordingly, because the left door 5 may rotate at a predetermined angle based on the hinge shaft 231, the left door 5 may selectively open and close the left side of the front surface of the cabinet 3.

The horizontal moving part 230' may be disposed on the upper side of the left fixing part 210' fixed to the cabinet 3, and may be formed to move linearly in a direction parallel to the cabinet 3. The horizontal moving part 230' may be formed of a flat plate, and may include a horizontal slide portion 232 that slides with respect to the left fixing part 210' and a horizontal hinge portion 233 in which the hinge shaft 231 is disposed. Like the horizontal slide portion 232 of the horizontal moving part 230 according to the above-described embodiment, the horizontal slide portion 232 may include a horizontal hooking portion 240, an avoidance opening 234, a guide opening 235, a pair of horizontal slide surfaces 234*a*, and a pair of horizontal sub-slide surfaces 235*a*. However, the horizontal moving part 230' according to this embodiment is different from the horizontal moving part 230 according to the above-described embodiment in a line-symmetric relationship.

The left hinge 200' may further include a hinge clamp 250'. The hinge clamp 250' may be formed to fix the horizontal moving part 230' to the left fixing part 210'. The structure of the hinge clamp 250' is the same as that of the hinge clamp 250 of the right hinge 200 according to the above-described embodiment; therefore, a detailed description thereof is omitted.

Hereinafter, the operation of the left hinge 200' will be described in detail with reference to FIGS. 17A and 17B.

Figure 17A:
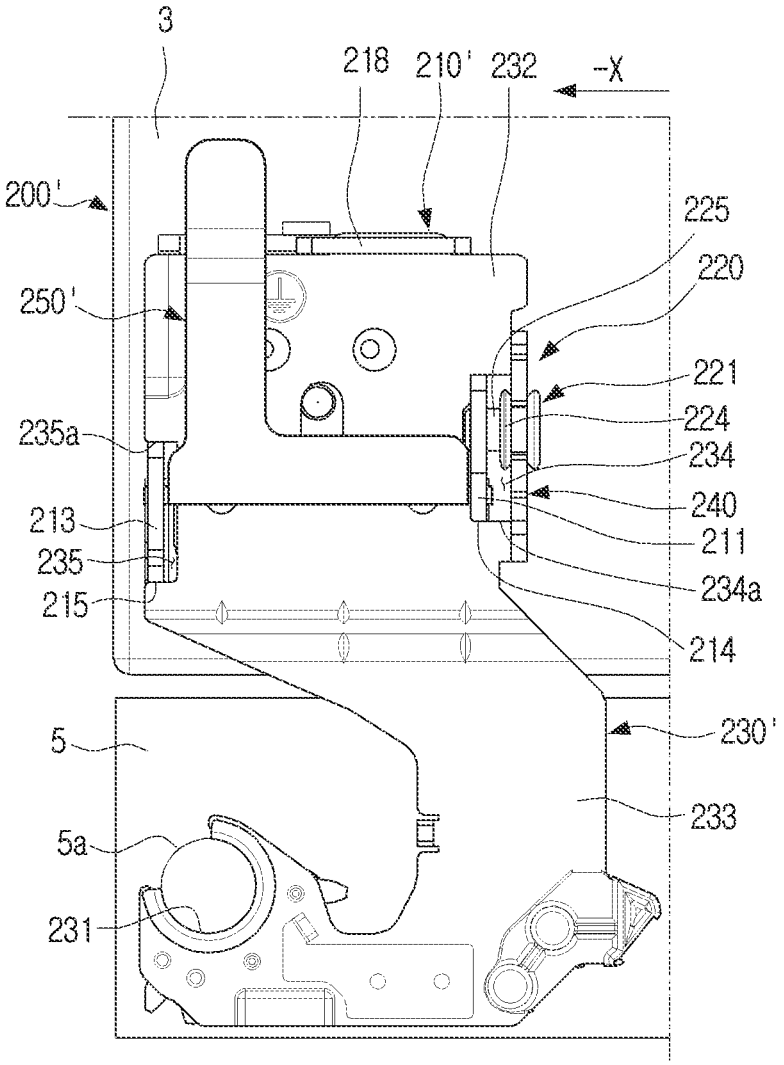
FIG. 17A is a view for explaining an operation of a horizontal moving part of a left hinge.
Figure 17B:
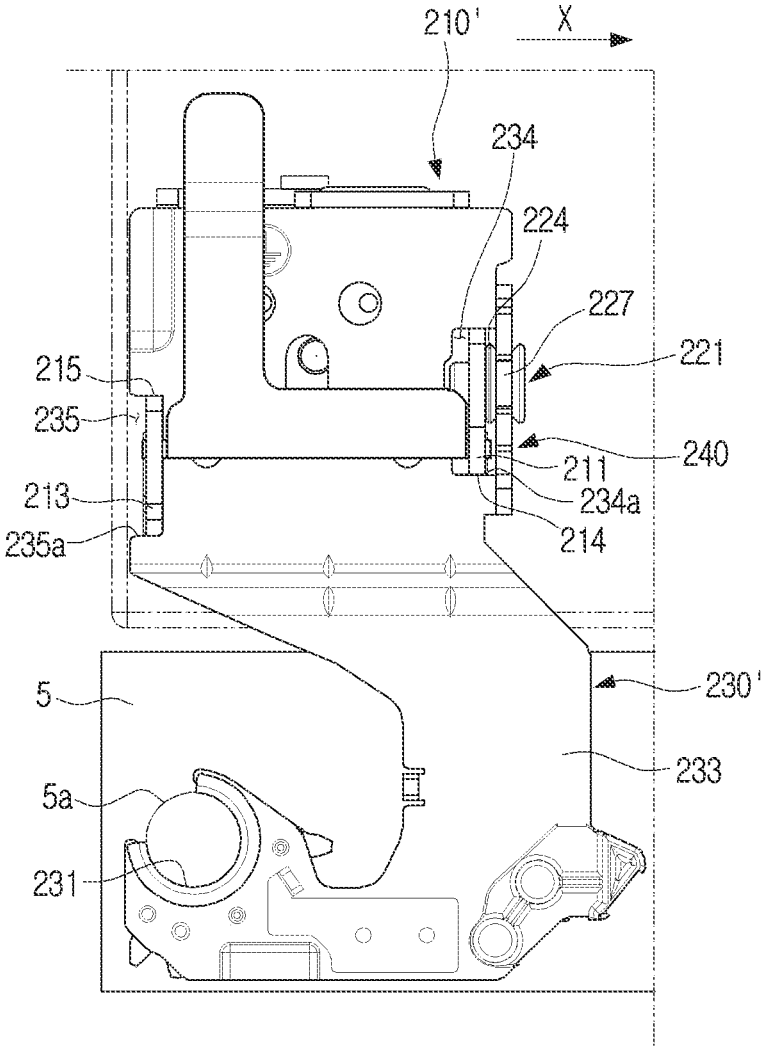
FIG. 17B is a view for explaining an operation of a horizontal moving part of a left hinge.

FIGS. 17A and 17B are a view for explaining an operation of a horizontal moving part of a left hinge.

Referring to FIG. 17A, the bottom surface 234*b* of the avoidance opening 234 of the horizontal moving part 230' is in contact with the front surface of the horizontal fixing portion 211 of the left fixing part 210'. In this state, when the horizontal adjustment bolt 221 is rotated in one direction, the threaded portion 225 of the horizontal adjustment bolt 221 is moved in the −X direction with respect to the bolt hole 212 of the horizontal fixing portion 211.

Because the horizontal hooking portion 240 of the horizontal moving part 230' is inserted into the engaging groove 227 of the horizontal adjustment bolt 221, when the horizontal adjustment bolt 221 moves in the −X direction, the horizontal hooking portion 240 is moved in the −X direction together with the horizontal adjustment bolt 221. Because the horizontal hooking portion 240 is formed integrally with the horizontal moving part 230', when the horizontal adjustment bolt 221 moves, the horizontal moving part 230' moves together in the −X direction. In other words, when the horizontal adjustment bolt 221 is rotated in one direction, the horizontal moving part 230' is moved in the −X direction.

The pair of horizontal slide surfaces 234*a* are formed on both inner side surfaces of the avoidance opening 234 of the horizontal moving part 230', and the pair of horizontal sub-slide surfaces 235*a* are formed on both inner side surfaces of the guide opening 235. The left fixing part 210' is provided with the pair of horizontal guide portions 214 corresponding to the pair of the horizontal slide surfaces 234*a* and the pair of horizontal sub-guide portions 215 corresponding to the pair of horizontal sub-slide surfaces 235*a*. Accordingly, the movement in the −X-direction of the horizontal moving part 230' is guided by the pair of horizontal slide surfaces 234*a* and the horizontal sub-slide surfaces 235*a* of the horizontal moving part 230' and the pair of horizontal guide portions 214 and the pair of horizontal sub-guide portions 215 of the left fixing part 210'. Because the pair of horizontal slide surfaces 234*a* and the horizontal sub-slide surfaces 235*a* of the horizontal moving part 230' and the pair of horizontal guide portions 214 and the pair of horizontal sub-guide portions 215 of the left fixing part 210' are formed in parallel to each other, when the horizontal adjustment bolt 221 is rotated in one direction, the horizontal moving part 230' may be linearly moved in the −X direction with respect to the left fixing part 210'.

When the horizontal adjustment bolt 221 is rotated to the maximum in one direction, the intermediate ring 224 of the horizontal adjustment bolt 221 comes into contact with the rear surface of the horizontal fixing portion 211 as illustrated in FIG. 17B. In this state, the horizontal moving part 230' may no longer move in the −X direction.

When the horizontal adjustment bolt 221 is rotated in the opposite direction in the state of FIG. 17B, the horizontal adjustment bolt 221 may be moved in the opposite direction with respect to the horizontal fixing portion 211, that is, in the X direction. At this time, the horizontal moving part 230' is moved in the X direction together with the horizontal adjustment bolt 221.

When the horizontal adjustment bolt 221 is rotated to the maximum in the opposite direction, the bottom surface 234*b* of the avoidance opening 234 of the horizontal moving part 230' comes into contact with the front surface of the horizontal fixing portion 211 as illustrated in FIG. 17A. When this state is reached, the horizontal moving part 230' may no longer move in the X direction.

Accordingly, the user may rotate the horizontal adjustment bolt 221 to move the left door 5 coupled to the hinge shaft 231 of the horizontal moving part 230' in a direction parallel to the front surface of the cabinet 3.

Hereinafter, the right hinge 100' will be described in detail with reference to FIG. 18.

Figure 18:
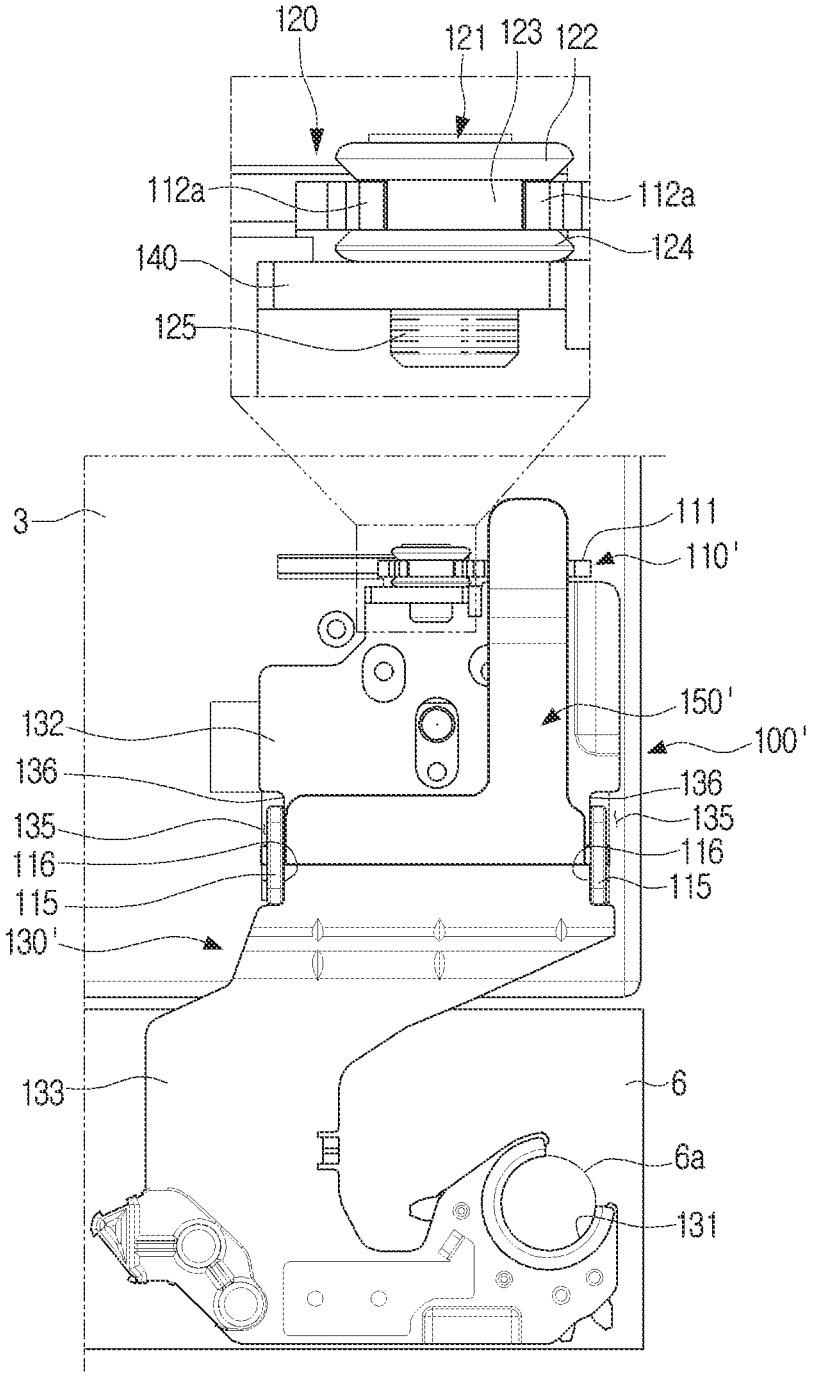
FIG. 18 is a plan view illustrating a right hinge of the refrigerator of FIG. 15.

FIG. 18 is a plan view illustrating a right hinge of the refrigerator of FIG. 15.

Referring to FIG. 18, the right hinge 100' may include a right fixing part 110' and a vertical moving part 130'.

The right fixing part 110' may be fixed to the cabinet 3 and may support the vertical moving part 130' so that the vertical moving part 130' may move. In other words, the right fixing part 110' may be disposed under the vertical moving part 130' and may be fixed to the upper surface of the cabinet 3.

The right fixing part 110' may include a vertical adjustment member 120 configured to move the vertical moving part 130' in a direction perpendicular to the front surface of the cabinet 3 (hereinafter referred to as a vertical direction), that is, in the Y direction. The right fixing part 110' may guide the vertical moving part 130' to linearly move in the vertical direction.

The right fixing part 110' may be formed in an approximately rectangular flat plate. Like the left fixing part 110 according to the above-described embodiment, the right fixing part 110' may include a vertical fixing portion 111, a pair of support portions 115, and a pair of guide surfaces 116. However, the right fixing part 110' according to this embodiment is different from the left fixing part 110 according to the above-described embodiment in a line-symmetric relationship.

The vertical moving part 130' may be coupled to the right door 6 and may be formed to move in the vertical direction with respect to the cabinet 3. One end of the vertical moving part 130' may be provided with a cylindrical hinge shaft 131 coupled to the right door 6. A hinge hole 6*a* into which the hinge shaft 131 is inserted may be provided at the upper end of the right door 6. Accordingly, because the right door 6 may rotate at a predetermined angle based on the hinge shaft 131, the right door 6 may selectively open and close the right side of the front surface of the cabinet 3.

The vertical moving part 130' may be disposed on the upper side of the right fixing part 110' fixed to the cabinet 3, and may be formed to move linearly in the vertical direction with respect to the cabinet 3. The vertical moving part 130' may be formed of a flat plate, and may include a vertical slide portion 132 that slides with respect to the right fixing part 110' and a vertical hinge portion 133 in which the hinge shaft 131 is disposed. Like the vertical slide portion 132 of the vertical moving part 130 of the left hinge 100 according to the above-described embodiment, the vertical slide portion 132 of the vertical moving part 130' may include a vertical connection portion 140 and a pair of vertical slide surfaces 136. However, the vertical moving part 130' of the right hinge 100' according to this embodiment is different from the vertical moving part 130 of the left hinge 100 according to the above-described embodiment in a line-symmetric relationship.

The right hinge 100' may further include a hinge clamp 150'. The hinge clamp 150' may be formed to fix the vertical moving part 130' to the right fixing part 110'. The structure of the hinge clamp 150' is the same as that of the hinge clamp 150 of the left hinge 100 according to the above-described embodiment; therefore, a detailed description thereof is omitted.

Hereinafter, the operation of the right hinge 100' will be described in detail with reference to FIGS. 19A and 19B.

Figure 19A:
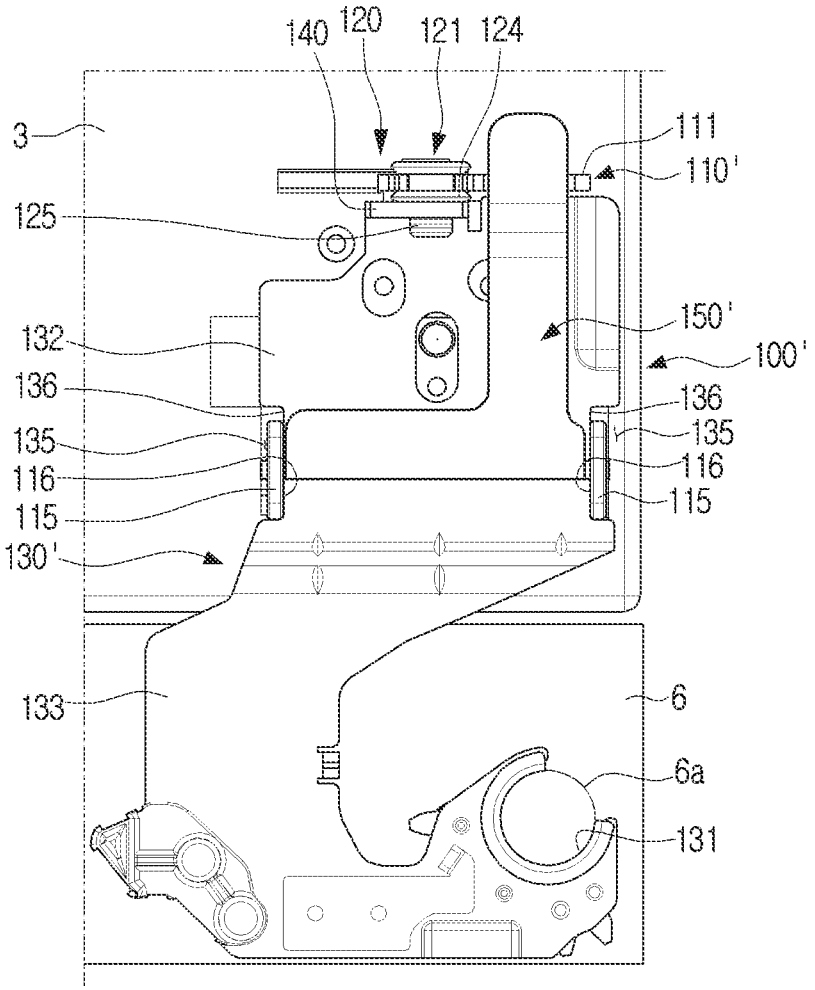
FIG. 19A is a view for explaining an operation of a vertical moving part of a right hinge.
Figure 19B:
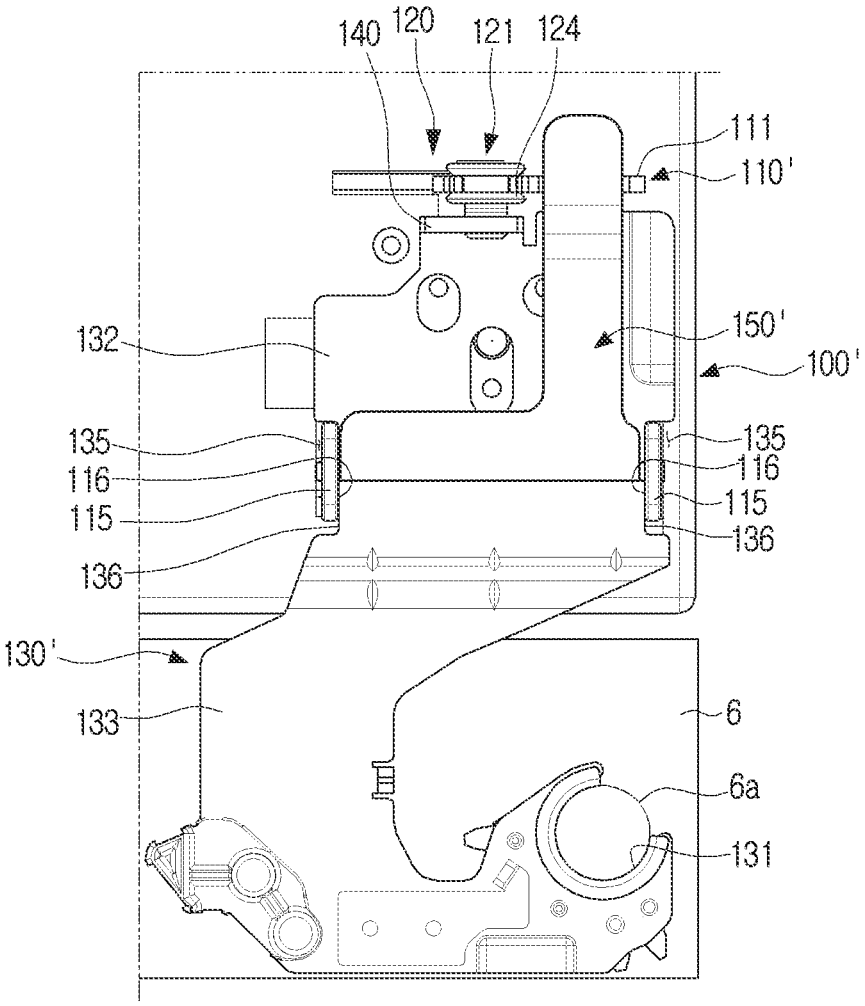
FIG. 19B is a view for explaining an operation of a vertical moving part of a right hinge.

FIGS. 19A and 19B are views for explaining an operation of a vertical moving part of a right hinge.

Referring to FIG. 19A, the rear surface of the vertical connection portion 140 of the vertical moving part 130' is in contact with the intermediate ring 124 of the vertical adjustment bolt 121 coupled to the vertical fixing portion 111 of the right fixing part 110'. In this state, when the vertical adjustment bolt 121 is rotated in one direction, the vertical connection portion 140 fastened to the threaded portion 125 of the vertical adjustment bolt 121 is moved in the longitudinal direction of the vertical adjustment bolt 121, that is, in the Y direction. Because the vertical connection portion 140 is integrally formed with the vertical moving part 130', when the vertical connection portion 140 is moved, the vertical moving part 130' is moved along with the vertical connection portion 140 in the Y direction. In other words, when the vertical adjustment bolt 121 is rotated in one direction, the vertical moving part 130' is moved in the Y direction.

The pair of vertical slide surfaces 136 are formed on both side surfaces of the vertical moving part 130', and the pair of vertical guide surfaces 116 corresponding to the pair of vertical slide surfaces 136 are provided in the right fixing part 110'. Accordingly, the Y-direction movement of the vertical moving part 130' is guided by the pair of vertical slide surfaces 136 of the vertical moving part 130' and the pair of vertical guide surfaces 116 of the right fixing part 110'. Because the pair of vertical slide surfaces 136 of the vertical moving part 130' and the pair of vertical guide surfaces 116 of the right fixing part 110' are formed to be parallel to each other, when the vertical adjustment bolt 121 is rotated in one direction, the vertical moving part 130' may be linearly moved in the Y direction with respect to the right fixing part 110'.

When the vertical adjustment bolt 121 is rotated to the maximum in one direction, one inner side surface of each of the pair of moving grooves 135 of the vertical moving part 130' comes into contact with each of the pair of the support portions 115 of the right fixing part 110' as illustrated in FIG.

19B. In this state, the vertical moving part 130' may no longer move in the Y direction.

When the vertical adjustment bolt 121 is rotated in the opposite direction in the state of FIG. 19B, the vertical moving part 130' coupled to the vertical adjustment bolt 121 may be moved in the −Y direction with respect to the right fixing part 110'.

When the vertical adjustment bolt 121 is rotated to the maximum in the opposite direction, the rear surface of the vertical connection portion 140 of the vertical moving part 130' comes into contact with the intermediate ring 124 of the vertical adjustment bolt 121 as illustrated in FIG. 19A. When this state is reached, the vertical moving part 130' may no longer move in the −Y direction.

Accordingly, the user may rotate the vertical adjustment bolt 121 to move the right door 6 coupled to the hinge shaft 131 of the vertical moving part 130' in a direction perpendicular to the front surface of the cabinet 3.

As described above, in the refrigerator 1 according to this embodiment, the level difference between the left door 5 and the right door 6 may be removed by adjusting the vertical adjustment bolt 121 of the right hinge 100' that may move the right door 6 in a direction perpendicular to the front surface of the cabinet 3. In addition, the gap between the left door 5 and the right door 6 may be adjusted by using the horizontal adjustment bolt 221 of the left hinge 200' that may move the left door 5 in a direction parallel to the front surface of the cabinet 3.

As described above, with the refrigerator having the hinge according to an embodiment of the disclosure, the level difference and the gap between the left door and the right door may be adjusted. Therefore, the manufacturing cost of the refrigerator may be reduced.

Hereinabove, the disclosure has been described as an illustrative method. It is to be understood that terms used herein are provided to describe the disclosure rather than limiting the disclosure. Various modifications and alternations of the disclosure may be made according to the contents described above. Therefore, the disclosure may be freely practiced without departing from the scope of the claims unless additionally mentioned.

What is claimed is:

1. A refrigerator comprising:

a cabinet;

a door formed to open and close the cabinet;

an upper moving part coupled to the door and moveable with the door in a first direction with respect to the cabinet;

a lower moving part disposed under the upper moving part, including an upper adjustment member configured to move the upper moving part in the first direction, and configured to guide a linear movement of the upper moving part in the first direction; and a fixing part fixedly connected to the cabinet under the lower moving part, including a lower adjustment member configured to move the lower moving part in a second direction perpendicular to the first direction, and configured to guide a linear movement of the lower moving part in the second direction to thereby move the upper moving part in the second direction, wherein when the upper moving part or the lower moving part is moved, the fixing part remains stationary with respect to the cabinet.

2. The refrigerator as claimed in claim 1, wherein the upper adjustment member comprises:

an upper fixing portion extending vertically from an end of the lower moving part; and an upper adjustment bolt fastened to the upper fixing portion and configured to rotate in the upper fixing portion to move the upper moving part in the first direction with respect to the lower moving part.

3. The refrigerator as claimed in claim 2, wherein the upper adjustment bolt includes an engaging groove, wherein the upper moving part includes an upper hooking portion configured to be inserted in the engaging groove of the upper adjustment bolt, and wherein when the upper adjustment bolt is rotated while the upper hooking portion of the upper moving part is inserted in the engaging groove of the upper adjustment bolt, the upper moving part is moved in the first direction with respect to the lower moving part.

4. The refrigerator as claimed in claim 3, wherein the upper moving part includes an upper avoidance opening that is formed in front of the upper hooking portion and into which the upper fixing portion of the lower moving part is insertable.

5. The refrigerator as claimed in claim 1, wherein the lower adjustment member comprises:

a lower fixing portion extending vertically from an end of the fixing part; and a lower adjustment bolt fastened to the lower fixing portion and configured to move the lower moving part in the second direction with respect to the fixing part.

6. The refrigerator as claimed in claim 5, wherein the lower adjustment bolt includes an engaging groove, wherein the lower moving part includes a lower hooking portion configured to be inserted in the engaging groove of the lower adjustment bolt, and wherein when the lower adjustment bolt is rotated while the lower hooking portion of the lower moving part is inserted in the engaging groove of the lower adjustment bolt, the lower moving part is moved in the second direction with respect to the fixing part.

7. The refrigerator as claimed in claim 6, wherein the lower moving part includes a lower avoidance opening that is formed in front of the lower hooking portion and into which the lower fixing portion of the fixing part is insertable.

8. The refrigerator as claimed in claim 7, wherein both side surfaces of the lower fixing portion of the fixing part and both inner side surfaces of the lower avoidance opening of the lower moving part are formed to guide the linear movement of the lower moving part in the second direction.

9. The refrigerator as claimed in claim 1, wherein the upper moving part includes a pair of upper slide surfaces formed to be in parallel in the first direction, and the lower moving part includes a pair of upper guide portions to guide the pair of upper slide surfaces so that the upper moving part linearly moves in the first direction.

10. The refrigerator as claimed in claim 9, wherein the pair of upper slide surfaces of the upper moving part are formed on both side surfaces of the upper moving part, and the pair of upper guide portions of the lower moving part are formed on a pair of sidewalls extending vertically from both side surfaces of the lower moving part.

11. The refrigerator as claimed in claim 1, wherein the lower moving part includes a pair of lower slide surfaces formed to be in parallel in the second direction, and the fixing part includes a pair of lower guide portions to guide the pair of lower slide surfaces so that the lower moving part linearly moves in the second direction.

12. The refrigerator as claimed in claim 11, wherein the pair of lower slide surfaces of the lower moving part are formed on both inner side surfaces of the lower avoidance opening of the lower moving part and both inner side surfaces of a guide opening formed at a sidewall of the lower moving part, and the pair of lower guide portions of the fixing part are formed on both side surfaces of a lower fixing portion and a support portion extending vertically from both side surfaces of the fixing part.

* * * * *